US011597055B2

(12) United States Patent
Son et al.

(10) Patent No.: US 11,597,055 B2
(45) Date of Patent: Mar. 7, 2023

(54) CARRIER HEAD OF POLISHING APPARATUS AND MEMBRANE USED THEREIN

(71) Applicant: KCTECH CO., LTD., Anseong-si (KR)

(72) Inventors: Jun Ho Son, Gyeongsan-si (KR); Sung Ho Shin, Yongin-si (KR)

(73) Assignee: KCTECH CO., LTD., Anseong-si (KR)

( * ) Notice: Subject to any disclaimer, the term of this patent is extended or adjusted under 35 U.S.C. 154(b) by 861 days.

(21) Appl. No.: 16/400,554

(22) Filed: May 1, 2019

(65) Prior Publication Data

US 2020/0147751 A1 May 14, 2020

(30) Foreign Application Priority Data

Nov. 9, 2018 (KR) ..... 10-2018-0137685

(51) Int. Cl.

| | |
|---|---|
| ***B24B 37/04*** | (2012.01) |
| ***B24B 37/30*** | (2012.01) |
| ***B24B 37/32*** | (2012.01) |
| *B24B 37/005* | (2012.01) |

(52) U.S. Cl.

CPC ..... *B24B 37/30* (2013.01); *B24B 37/04* (2013.01); *B24B 37/32* (2013.01); *B24B 37/005* (2013.01)

(58) Field of Classification Search

CPC ..... B24B 37/27; B24B 37/30; B24B 37/32; B24B 37/07; B24B 37/10; B24B 37/105; B24B 37/107; B24B 37/042; B24B 7/228; B24B 37/04

USPC ..... 451/41, 285, 287, 397, 398

See application file for complete search history.

(56) References Cited

U.S. PATENT DOCUMENTS

| | | | | |
|---|---|---|---|---|
| 7,842,158 | B2 * | 11/2010 | Chen | B24B 37/30 156/345.12 |
| 2017/0144267 | A1 * | 5/2017 | Fukushima | B24B 37/30 |
| 2018/0117730 | A1 * | 5/2018 | Nabeya | B24B 37/32 |
| 2018/0301367 | A1 * | 10/2018 | Yamaki | B24B 37/107 |
| 2020/0023487 | A1 * | 1/2020 | Namiki | B23Q 15/16 |
| 2020/0147751 | A1 * | 5/2020 | Son | B24B 37/04 |

FOREIGN PATENT DOCUMENTS

| | | | | |
|---|---|---|---|---|
| WO | WO-0021715 | A2 * | 4/2000 | B24B 37/30 |

OTHER PUBLICATIONS

WO-0021715-A2 translation (Year: 2000).*

* cited by examiner

*Primary Examiner* — Eileen P Morgan
(74) *Attorney, Agent, or Firm* — Stein IP, LLC

(57) ABSTRACT

Provided are a membrane and carrier head using the membrane for polishing apparatus. The membrane comprises a first fixing flap extending inwards from the upper part of a side portion, a second fixing flap extending upwards from the upper part of the side portion, wherein the second fixing flap has a first inclined part, a second inclined part and a third extending part of extending upwards whereby a compensation force generated by the inclined parts realize the constant pressing force to the edge of a substrate during a polishing process.

7 Claims, 19 Drawing Sheets

CARRIER HEAD OF POLISHING APPARATUS AND MEMBRANE USED THEREIN

CROSS-REFERENCE TO RELATED APPLICATIONS

This U.S. non-provisional patent application claims priority under 35 U.S.C. § 119 of Korean Patent Application No. 10-2018-0137685 filed on Nov. 9, 2018, the entire contents of which are hereby incorporated by reference.

BACKGROUND OF THE INVENTION

The present invention disclosed herein relates to a carrier head of a polishing apparatus and the membrane used therein, and more particularly to a carrier head of a polishing apparatus and the membrane used therein for maintaining a polishing quality by applying a uniform pressing force to an edge of a substrate even when a wear amount of a retainer ring is changed.

The chemical mechanical polishing (CMP) apparatus is a device for precisely polishing the surface of wafer(s) such as a wide-area planarization that removes a height difference between a cell region and a peripheral circuit region due to unevenness of a wafer surface generated by repeatedly performing masking, etching, so as to improve the surface roughness of the wafer due to contact or wiring film separation and highly integrated elements, and the like.

In such a CMP apparatus, the carrier head presses the wafer in a state in which the polished surface of the wafer faces the polishing pad during polishing to perform the polishing process. Also, when the polishing process is finished, the wafer is held by direct or indirect vacuum-controlled adsorption and then moved to the next step.

FIGS. 1A and 1B are views showing the construction of a conventional polishing apparatus. As shown in the figures, the polishing apparatus 9 includes a polishing platen 10 that rotates 10*r* in a state that a polishing pad 11 is located on an upper surface thereof, a carrier head that presses substrate downwards to the polishing pad 11 so that the polishing surface of the substrate is maintained in contact with the polishing pad 11, a slurry supply 3 for supplying slurries for chemical polishing of the substrate W, and a conditioner for conditioning or dressing the polishing pad 11 during the polishing process of the substrate W.

The polishing surface of the substrate W is mechanically polished by friction with the polishing pad 11 while being pressed and rotated by the carrier head 2 against the polishing pad 11. At the same time, the slurry is supplied from the slurry supply port 31 to the substrate W and the chemical polishing process is performed on the polishing surface of the substrate W. The present invention may be applied to a case where both a mechanical polishing process and a chemical polishing process are performed together, and the present invention can also be applied to a case where only a mechanical polishing process is performed.

During the polishing process of the substrate, the conditioner 4 rotates conditioning disk as shown numeral of 41*r* while pushing downward the conditioning disk positioned at the end of the arm 41, and performs the reciprocating rotational motion 4*d* in the predetermined angular range, whereby conditioning process is performed over the entire area of the polishing pad 11.

As shown in FIG. 2, the carrier head 2 includes a main body 2*x* and a base 22 which receive rotational driving force from the outside and rotate, a membrane 21 fixed to the base 22, and a retainer ring 23 contacted with the polishing pad 11 as a shape of a ring apart from the membrane bottom portion 211 to prevent the substrate from escaping during the polishing process. Herein, the main body 2*x* and the base 22 may be integrally formed, or they may be connected to each other by a connecting member in a separated state.

Here, the membrane 21 has a membrane bottom portion 211 formed in the shape of the substrate W and adhered to the non-polished surface of the substrate, and a membrane side portion 212 extending upward from the edge of the membrane bottom portion 211, and plural partition flaps 213 extending from the membrane bottom portion 211 to be secured to the base 22. The ends of the partition flaps 213 are fixed by being caught in a gap between the engaging member 22*a* and the base 22 whereby the partition flaps 213 are fixed to the base 22.

The first fixing flap 2121 extends radially inward from the upper end of the membrane side portion 212 and is fixed in the gap between the engaging member 22*a* and the base 22. The second fixing flap 2122 extends upwardly from the membrane top end and is bent and extends radially inwardly. Similarly, the second fixing flaps 2122 are also fixed to the base 22 by fixing the ends into the gap between the fixing members 22*a* and the base 22.

In the specification and claim, engaging member 22*a* coupled to the base 22 as a whole is considered to be included as part of the base 22.

A plurality of main pressure chambers C1, C2, C3, C4 and C5 partitioned by the partition flaps 213 are formed between the membrane bottom portion 211 and the base 22. Accordingly, when the air pressure is supplied from the pressure control unit 25, the plural main pressure chambers C1, C2, C3, C4 and C5 are expanded and the force P for pressing the bottom portion 211 of the bottom of the main pressure chambers C1, C2, C3, C4 and C5 is controlled independently for each chamber. An auxiliary pressure chamber Cx is formed by the first fixing flap 2121, the second fixing flap 2122 and the base 22 at the upper end of the outermost main pressure chamber C5. As a result, the pressure Px of the auxiliary pressure chamber Cx pushes downward through the membrane side portion 212 to press the edge portion of the substrate W.

The retainer ring 23 is formed in the shape of a ring surrounding the periphery of the membrane bottom portion 211. The retainer ring 23 may be configured to be vertically movable by the pressure of the pneumatic chamber provided on the upper side of the retainer ring, or may be integrally formed with the body portion 2*x* as shown in the figures.

The carrier head 2 constructed as described above can obtain the uniform polishing quality of the substrate only by pressing the substrate W constantly during each polishing process.

However, when the polishing process is repeated, the retainer ring 23 and the polishing pad 11 are worn out, thereby causing the vertical position of the membrane to be different compared with the vertical positions in the previous polishing process. For example, in view of the wear of the retainer ring 23, because the distance between the membrane bottom portion 211 and the bottom surface of the retainer ring 23 is constant by the thickness tw of the substrate during the polishing process, as the wear amount of the retainer ring 23 increases, the upward lifted displacement of the membrane 99 is caused.

For the sake of convenience, FIG. 3A shows a state in which the membrane 21 has a predetermined shape in the polishing process as a reference position of the membrane, and FIG. 3B shows a state in which the membrane is lifted upward due to wear of the retainer ring 23. Herein, the state that the membrane is lifted upward means that 'the bottom separation distance y' between the membrane bottom part 211 and the polishing pad 11 is reduced in assumption that the substrate W is not positioned under the carrier head 2. Hereinafter, the present invention will be described on the 'bottom separation distance y' basis.

As described above, according to the amount of wear of the polishing pad and/or the retainer ring 23, when the membrane 21 moves up and down, a slight difference occurs in the flap shape of the membrane according to the upward or downward distance of the membrane 21.

Accordingly, when the flaps of the membrane 21 are in a predetermined shape, by adjusting appropriately the polishing process parameters such as pneumatic pressure, rotational speed, and the like, the polishing profile from the center to the edge of the substrate can be uniformly controlled as a whole as shown in the polishing profile of Si in FIG. 6.

However, as the amount of wear of the retainer ring 23 increases, the upward displacement 99 of the membrane 21 increase, so that the pressing force in the edge region of the substrate varies more.

That is, when the amount of wear of the retainer ring 23 increases and the bottom separation distance y reduces to y ', the membrane 21 is lifted upward as a whole and thus the membrane side portion 212 is moved upward. However, as the second fixing flap 2122 shaped as '¬' blocked on its horizontal part by the bottom surface of the base 22, and the displacement of the vertical part of the second fixing flap 2122 is restricted by the bottom surface of the base 22, and thus the reaction force generated by the upwardly lifted displacement of the membrane side portion 212 is transmitted downwardly as it is through the membrane side portion 212. Therefore the downward pressing force Fe' through the membrane side portion 212 at the membrane's lifted position as shown in FIG. 3B is bigger than the downward pressing force Fe through the membrane side portion 212 at the membrane's reference position as shown in FIG. 3A.

Accordingly, even if the polishing process parameters are set so as to obtain the uniform polishing profile shown in Si in FIG. 6 at the reference position shown in FIG. 3A, in case that the membrane side portion 212 is lifted due to wear of the retainer ring 23, it has been experimentally found that the polishing profile indicated by S1 in FIG. 6 is obtained because the removal amount at the edge portion of the substrate becomes larger than that at the reference position.

On the other hand, a method of lowering the pressure of the auxiliary pressure chamber Cx may be sought depending on the amount of wear of the retainer ring 23. However, as it is very difficult to precisely vary the pressure of the auxiliary pressure chamber Cx depending on the wear amount measurement value of the retainer ring 23 during the polishing process, it is not desirable to vary the pressure of the auxiliary pressure chamber Cx during the polishing process.

On the other hand, the membrane 21' of another type of carrier head 2' shown in FIG. 4 may be configured in a form without the auxiliary pressure chamber Cx. The membrane 21' has a low rigidity at the membrane side portion 212'. As the pressure in the outermost pressure chamber is increased, the edge portion of the membrane bottom portion 21*a* is lifted so that it is difficult to introduce a sufficient pressing force into the edge portion of the substrate. Therefore, even if the polishing process parameters are appropriately controlled, the polishing quality at the edge portion of the substrate is low and the polishing profile indicated by Si in FIG. 6 cannot be obtained, and the only polishing profile indicated by S3 in FIG. 6 is obtained.

Since the rigidity of the membrane side portion 212' is low, even if the auxiliary pressure chamber Cx is formed in the other type of carrier head 2' shown in FIG. 4, the pressure Px in the auxiliary pressure chamber Cx cannot be transmitted downward along the membrane side portion 212', which makes it difficult to obtain the polishing profile indicated by Si in FIG. 6.

On the other hand, with regard to the membrane 21 shown in FIG. 3B, when the amount of wear of the retainer ring 23 is increased and a displacement 99 is generated in which the membrane side portion 212 is lifted upward, the upper extending part Vx of the second fixed flap 2122 is in contact with the bottom surface Sb of the base 22 and the force of pushing down the membrane side portion 212 by the reaction force becomes greater, which has been a problem to control the removal rate at the edge of the substrate.

In order to solve such a problem, it is possible to find a method of forming the second fixing flap 2122" with the corrugated portion 88 as shown in FIG. 5. In case that the second fixing flap 2122" has the corrugated portion 88, even if the membrane side portion 212 is lifted upwards in accordance with the amount of wear of the retainer ring 23, as the corrugated portion 88 of the second fixing flap 2122" allows the upward displacement of the membrane side portion 212, it is possible to prevent the problem that the magnitude of the pressing force Fe" applied to the edge of the substrate through the membrane side portion 212 becomes larger.

However, in the structure in which the corrugated portion 88 is formed on the second fixing flap 2122" and its end is fixed at the bottom surface of the base 22, as the second fixing flap 2122" is extended long from the corrugated portion 88 to the fixed end, the centrifugal force is generated by the carrier head 2" during the polishing process thereby twisting the edge portion of the membrane. As a result, the membrane side portion 212 is rocked with vibration and the pressing force for pressing the edge portion of the substrate is also rocked thereby causing a problem of lowering the polishing quality of the edge portion of the substrate.

In addition, the horizontal part extending in the horizontal direction between the corrugated portion 88 and the end portion is separated from the bottom surface Sb of the base 22 due to the centrifugal force in accordance with the high speed rotation during the polishing process. Accordingly, even if the force acting on the corrugated portion 88 is canceled with each other in the vertical direction, the upward force Fd acts on the bottom surface of the horizontal part of the second fixing flap 2122". Thus the second fixing flap 2122" causes a force Fr to lift the membrane side portion 212 upwards and the upward displacement of on the membrane side portion 212 is amplified as the amount of wear of the retainer ring 23. Accordingly the pressing force Fe" to the substrate edge through the membrane side portion 212 with this constitution is rather lower at the reference position than that Fe with the auxiliary pressure chamber Cx.

Therefore, even if the polishing process parameters are set so as to be the polishing profile of Si of FIG. 6 with the membrane 21" shown in FIG. 5, as the polishing process is repeated and the amount of wear of the bottom surface of the retainer ring 23 increases, it is experimentally confirmed that the pressing force Fe" to the substrate edge is gradually lower thereby obtaining the polishing profile S2 in FIG. 6.

As above, the polishing process parameters such as the rotation speed of the carrier head, the pressure of the main pressure chambers and the auxiliary pressure chamber, and the rotation speed of the polishing platen are adjusted in order that the polishing profile of the substrate W becomes a uniform profile Si from the center to the edge portion of the substrate, a problem arises in that the polishing quality of the edge portion of the substrate fluctuates as the bottom distance y between the membrane bottom portion 211 and the polishing pad 11 varies with the progress of the polishing process.

In addition, when the centrifugal force is applied due to the rotation of the carrier head 2, distortion is generated in the membrane side portion 212 and the second fixing flap 2122" so that the edge portion of the substrate cannot be inadequately pressed thereby causing the polishing quality deteriorated.

Therefore, there is a strong demand for a membrane structure in that the amount of polishing at the edge portion of the substrate is uniformly maintained, although the setting of the polishing process parameters is not changed during the polishing process or by the polishing process or depending on polishing processes, and that a constant pressing force is applied to the edge of the substrate regardless of the amount of wear of the retainer ring and/or of the polishing pad.

It is also required to solve the problem that the pressing force is not sufficiently applied or applied with fluctuated vibration to the edge portion of the substrate due to the twisted distortion of the membrane during the polishing process and results in the deterioration of polishing quality.

The above-described background art describes other configurations obtained in the course of deriving the present invention to facilitate understanding of the present invention, and does not mean the prior art known before the filing date of the present invention.

SUMMARY OF THE INVENTION

The present invention has been made in view of the technical background described above and it is an object of the present invention to provide a membrane and carrier head having a structure of uniformly maintaining the pressing force applied to the edge of the substrate regardless of the amount of wear of the retainer ring and/or the polishing pad.

The present invention also has an object of minimizing twisting deformation of the membrane by the centrifugal force of the carrier head rotating at high speed during the polishing process and thus of applying a constant pressing force to the edge of the substrate.

In order to achieve the above object, the present invention provides a membrane of carrier head for polishing apparatus comprising: a bottom portion formed of flexible material to press the substrate during a polishing process; a side portion formed of at least one material including flexible material and 5 extending from the edge of the membrane bottom portion; and a first fixing flap formed of flexible material, including a first inclined part formed to be inclined upwardly and radially inwardly and a second inclined part formed to be inclined upwardly and radially outwardly, wherein the first fixing flap extends from one of the side portion and the first fixing flap.

The term of "outside" or "outer" or its similar terms in this specification and claims is defined as referring to a radially outward direction (r) from the center of the membrane bottom portion. Similarly, the term of "inside" or "inner" or its similar terms in this specification and claims is defined as referring to the radially inward direction from the center of the membrane bottom portion.

The term of "upper" or "upward" or its similar terms in this specification and claims is defined as referring to a direction (z) away from the membrane bottom portion toward the base.

The terms of "horizontal distance" or its similar terms in this specification and claims are defined as referring to the separation distance in a direction parallel to the membrane bottom portion.

The phrase of "horizontal plane" or its similar phrase in this specification and claims is defined as referring to an arbitrary virtual horizontal plane parallel to the membrane bottom portion.

The phrase of "outermost main chamber" in this specification and claims is defined as referring to a main pressure chamber which is located at the outermost position from the center of the membrane bottom portion and includes a pressing surface as a part of the membrane bottom portion to press the substrate.

The phrase of "auxiliary pressure chamber" in this specification and claims is defined as referring to a ring-shaped pressure chamber located above the outermost main chamber with a first fixing flap as a boundary.

The phrase of "bottom separation distance y" in this specification and claims is defined as referring to the distance, with the assumed condition that the substrate W is not positioned below the carrier head during polishing process and that predetermined pressure P is supplied to the pressure chamber(s) of the carrier head, which is a distance between the membrane bottom portion and the upper surface of the polishing pad.

Thus, in case that the substrate is located under the carrier head, and that the retainer ring is fixed to the carrier head, as the wear amount of the retainer ring increases, the bottom separation distance becomes smaller and the membrane is lifted upwards. In other case that the substrate is located under the carrier head, and that the retainer ring is movable in vertical direction with respect to the carrier head, as the wear amount of the retainer ring increases, the bottom separation distance becomes larger and the membrane is moved downwards.

The phrase of "reference position" in this specification and claims is defined as referring to an arbitrary position in which the retainer ring is not abraded for comparing states before and after abrasion of the retainer ring. That is, the pre-wear state of the retainer ring or the polishing pad is referred to as a "reference position" for relatively comparing the pre-wear state and the subsequent state of the retainer ring or the polishing pad. Therefore, the 'reference position' can be determined arbitrarily. For convenience of explanation, the embodiment of the present invention has been described by exemplifying 'the state in which the fixing flap of the membrane maintains its original shape (FIG. 9A)'.

According to the present invention, even if abrasion of the polishing pad or the retainer ring progresses while repeating the polishing process, and it causes the displacement in which the membrane side portion moves in the vertical direction, as uniform pressing force is applied to the edge of the substrate, there is an advantageous effect of realizing a polishing process for forming the polishing profile uniformly.

That is, the present invention provides an effect of uniformly applying the pressing force to the edge of the substrate without changing the polishing process parameters during the polishing process, even if the bottom separation distance y between the membrane bottom portion and the polishing pad varies.

Accordingly, the present invention can obtain an effect of reliably achieving the polishing quality of the substrate.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

Figure 7:
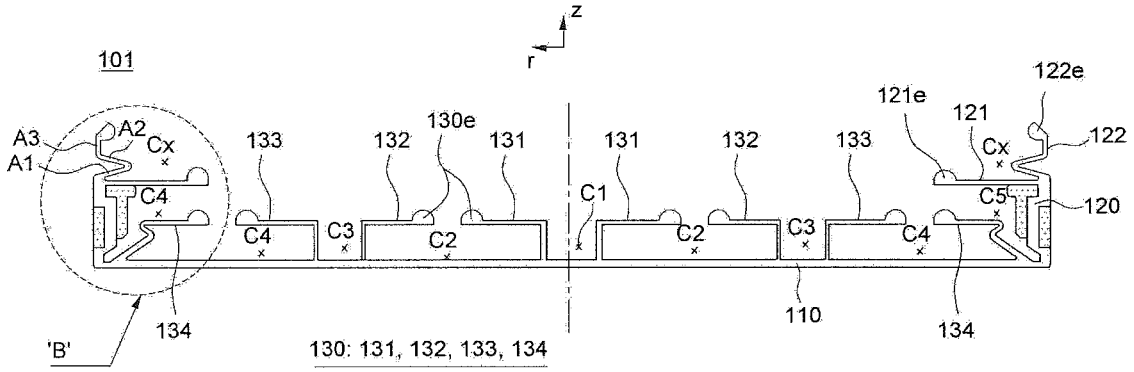
FIG. 7 is a cross-sectional view showing the membrane of the carrier head of the substrate polishing apparatus according to a first embodiment of the present invention.

9C is a view showing that a pressing force is acting downwards through the membrane side portion during the polishing process by the membrane in FIG. 7 mounted on the carrier head, where the membrane side portion moves downwards with the increase of the bottom separation distance.

Figure 9A:
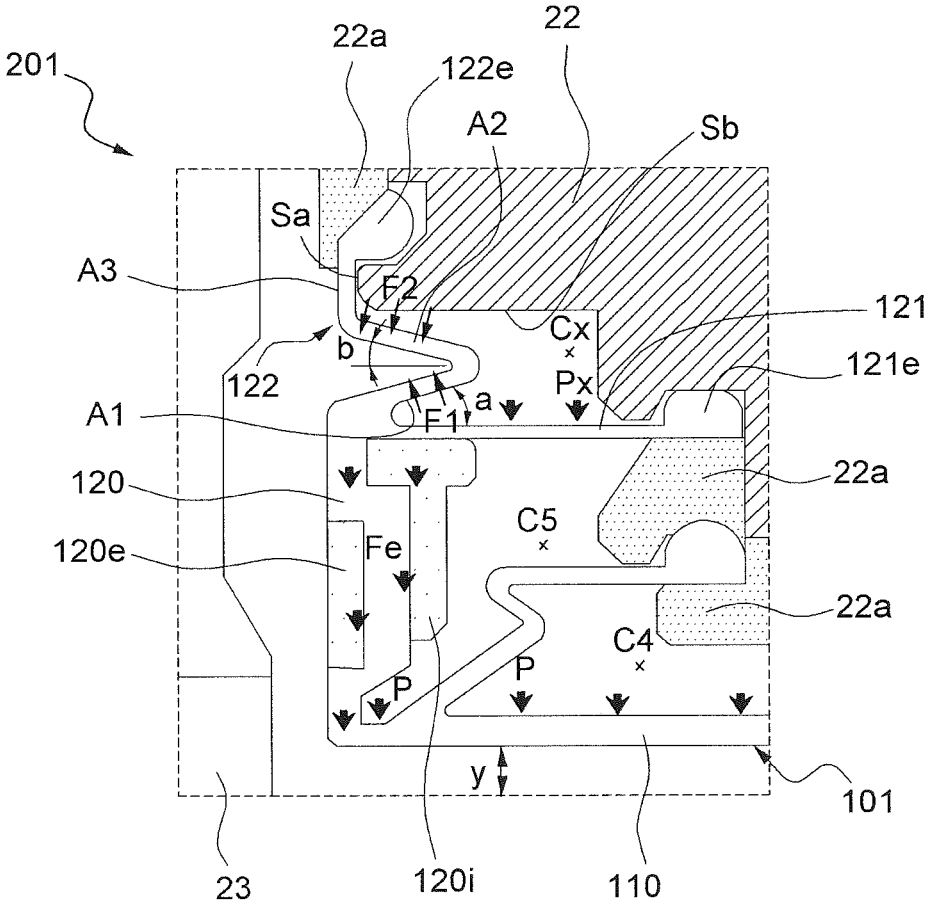
FIG. 9A is a view corresponding to the portion "A" in FIG. 2, showing the state in which the membrane of FIG. 7 is installed on the carrier head and the pressing force is applied during the polishing process.
Figure 9B:
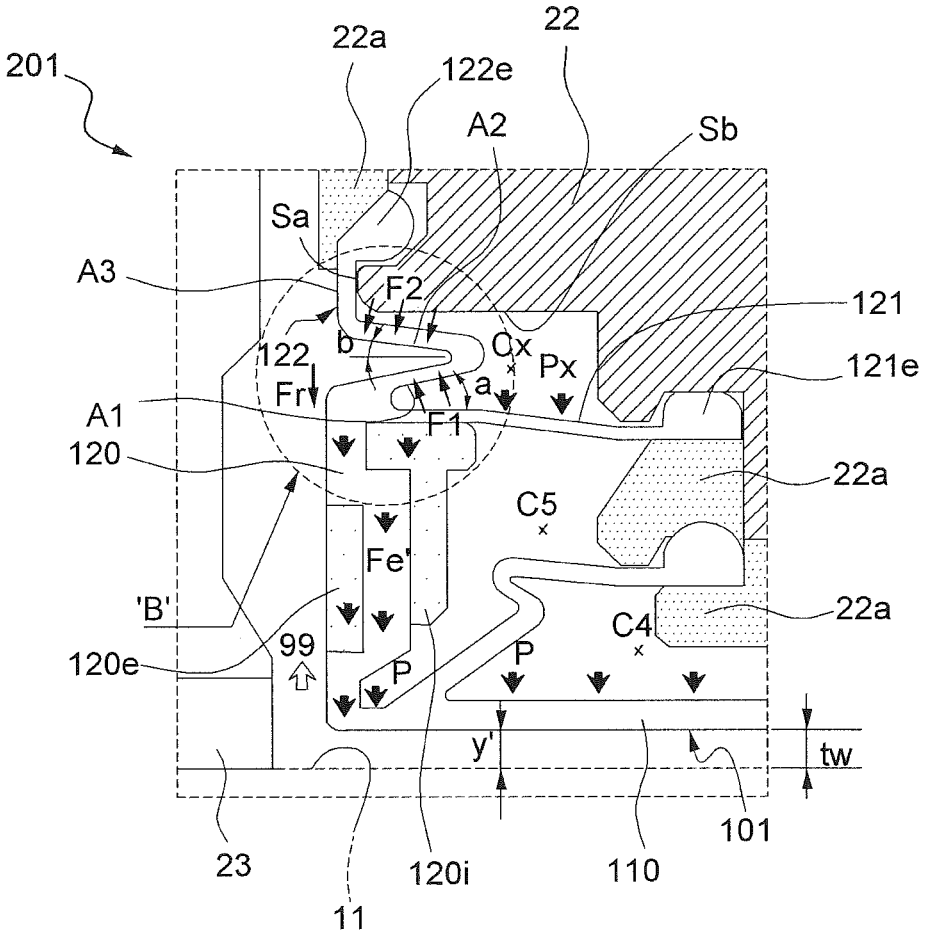
FIG. 9B is a view showing that a pressing force is acting downwards through the membrane side portion during the polishing process by the membrane in FIG. 7 mounted on the carrier head, where the membrane side portion is moved upwards with the decrease of the bottom separation distance.
Figure 10:
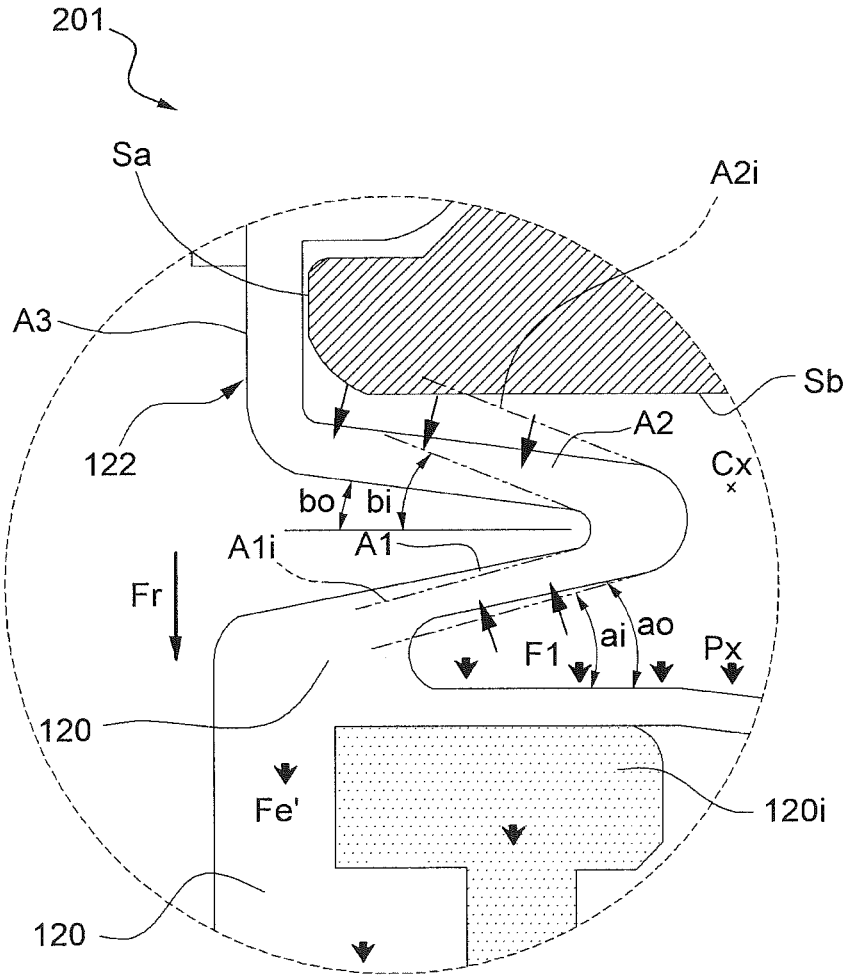

FIG. 10 is an enlarged view of a portion 'B' in FIG. 9B.

Figure 11:
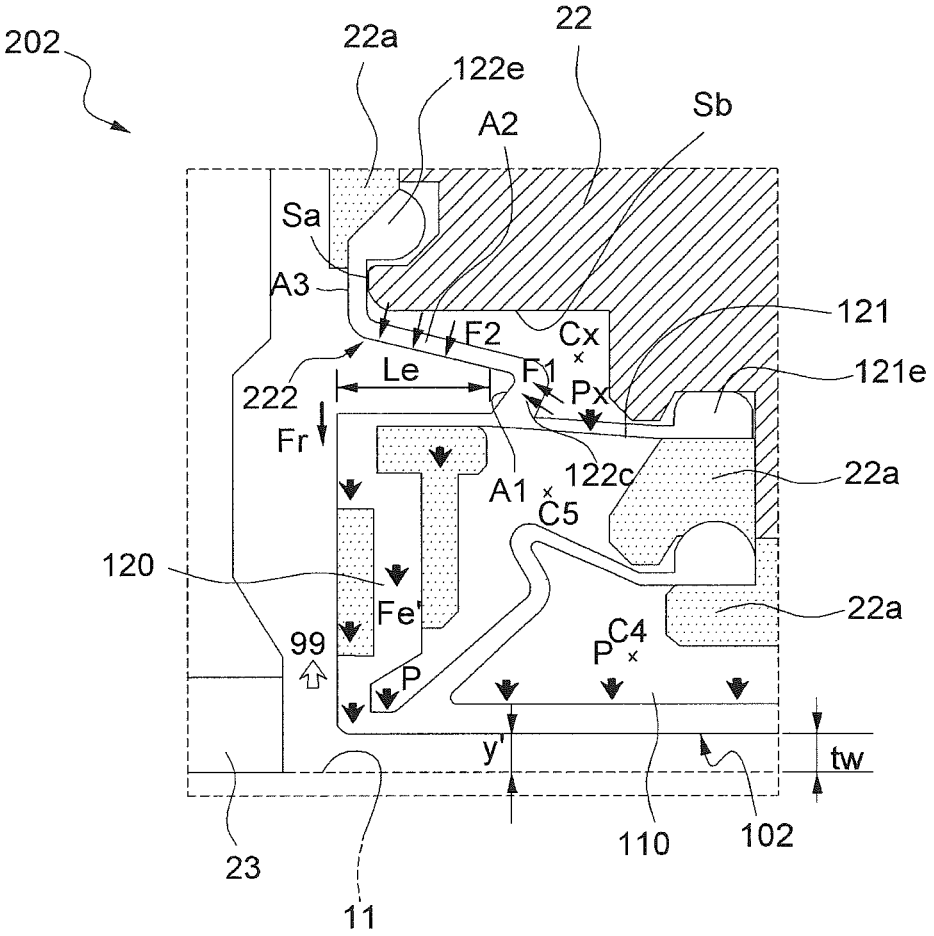

FIG. 11 is a view showing that a pressing force is acting downwards through the membrane side portion during the polishing process by the membrane according to a second embodiment of the present invention, where the membrane side portion is moved upwards with the decrease of the bottom separation distance.

Figure 12:
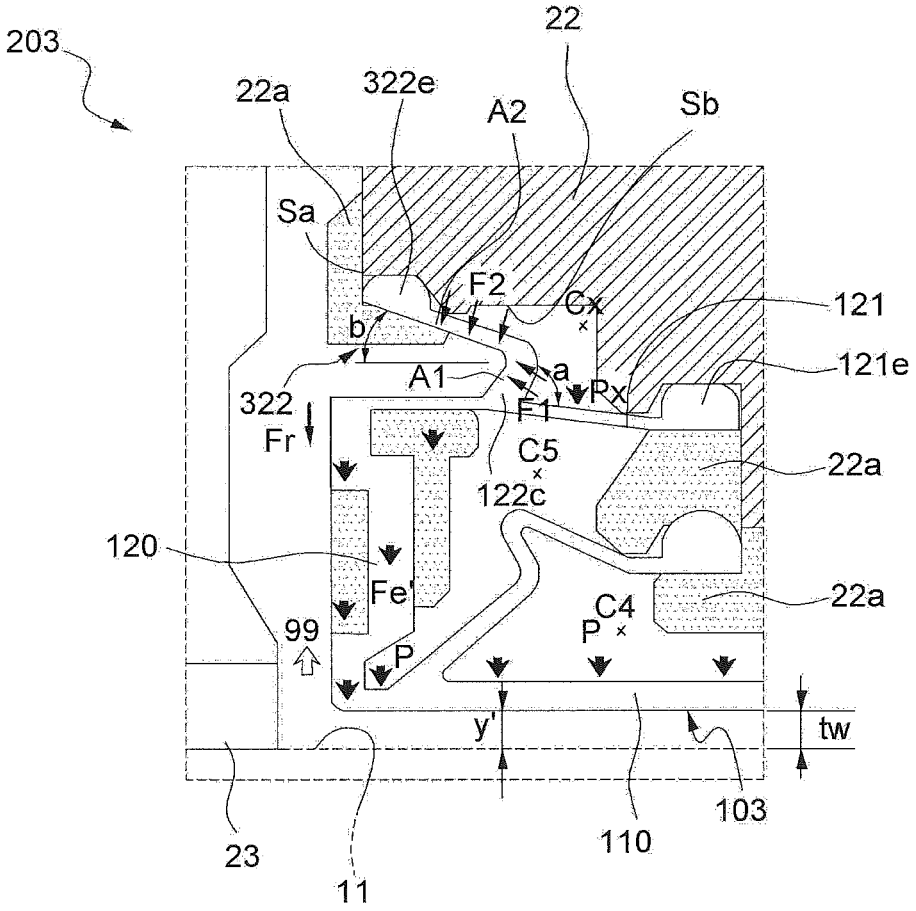

FIG. 12 is a view showing that a pressing force is acting downwards through the membrane side portion during the polishing process by the membrane according to a third embodiment of the present invention, where the membrane side portion is moved upwards with the decrease of the bottom separation distance.

Figure 13:
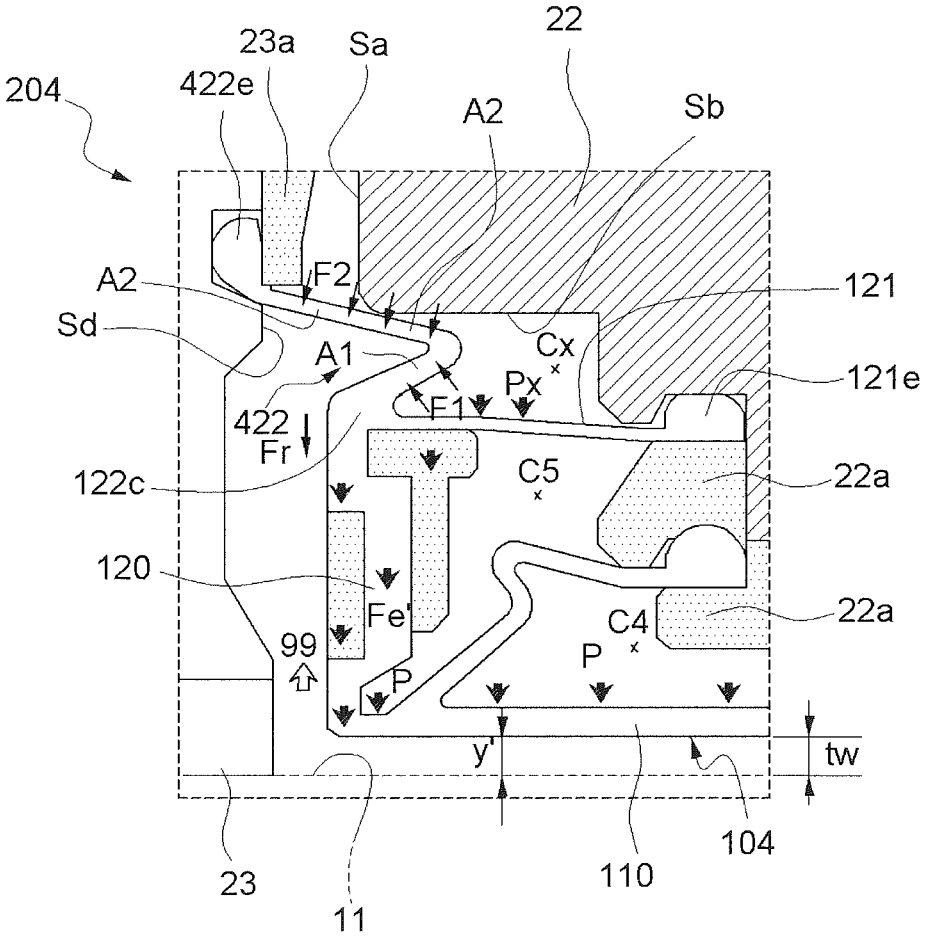

FIG. 13 is a view showing that a pressing force is acting downwards through the membrane side portion during the polishing process by the membrane according to a fourth embodiment of the present invention, where the membrane side portion is moved upwards with the decrease of the bottom separation distance.

Figure 14:
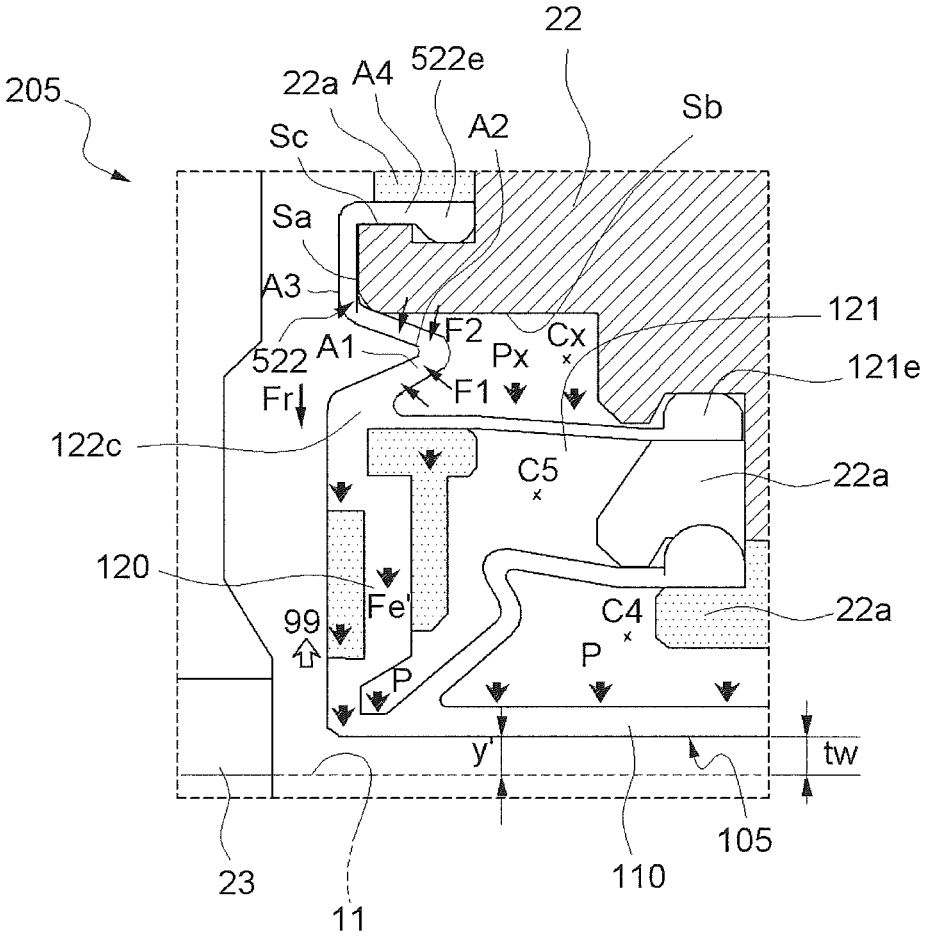

FIG. 14 is a view showing that a pressing force is acting downwards through the membrane side portion during the polishing process by the membrane according to a fifth embodiment of the present invention, where the membrane side portion is moved upwards with the decrease of the bottom separation distance.

Figure 15:
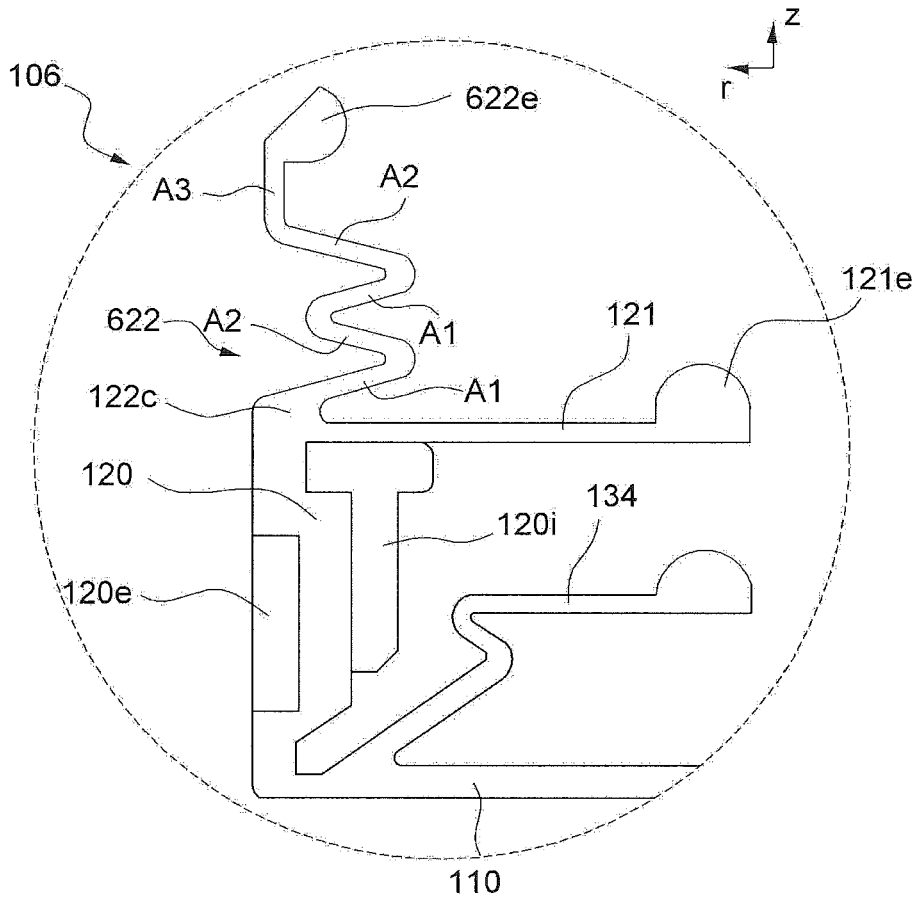

FIG. 15 is an enlarged view of an edge portion of a membrane of a carrier head of a substrate polishing apparatus according to a sixth embodiment of the present invention.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

The carrier head 201 for a substrate polishing apparatus according to a first embodiment of the present invention comprises similarly to the configuration of the carrier head 2 described with reference to FIG. 2. That is, the carrier head 201 comprises a main body 2*x* connected to a driving shaft (not shown) and driven to rotate, a base 22 connected to the main body 2*x* and rotates together with the main body 2*x*, a retainer ring 23 shaped as a ring and connected to at least one of the main body 2*x* or the base 22 and rotates therewith, a membrane 101 formed as a flexible material allowing stretching deformation and bending deformation and fixed to the base 22 for forming main pressure chambers C1, C2, C3, C4 and C5 and an auxiliary pressure chamber Cx between the membrane 101 and the base 22, and a pressure control unit 25 for controlling the pressure of the main pressure chambers C1, C2, C3, C4 and C5 and the auxiliary pressure chamber Cx by supplying air thereto.

Figure 1A:
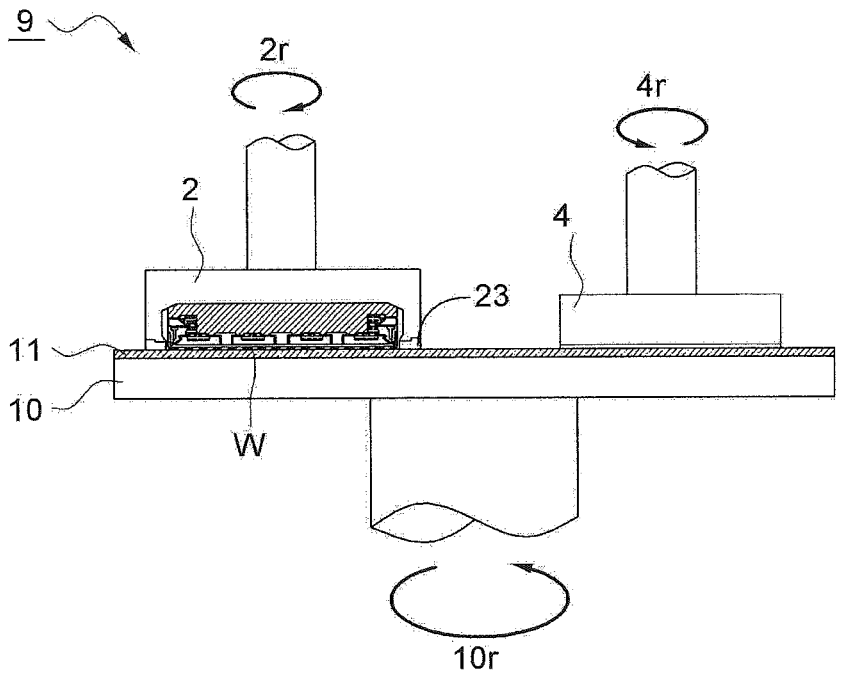
FIG. 1A is a front view showing a configuration of a general substrate polishing apparatus.
Figure 1B:
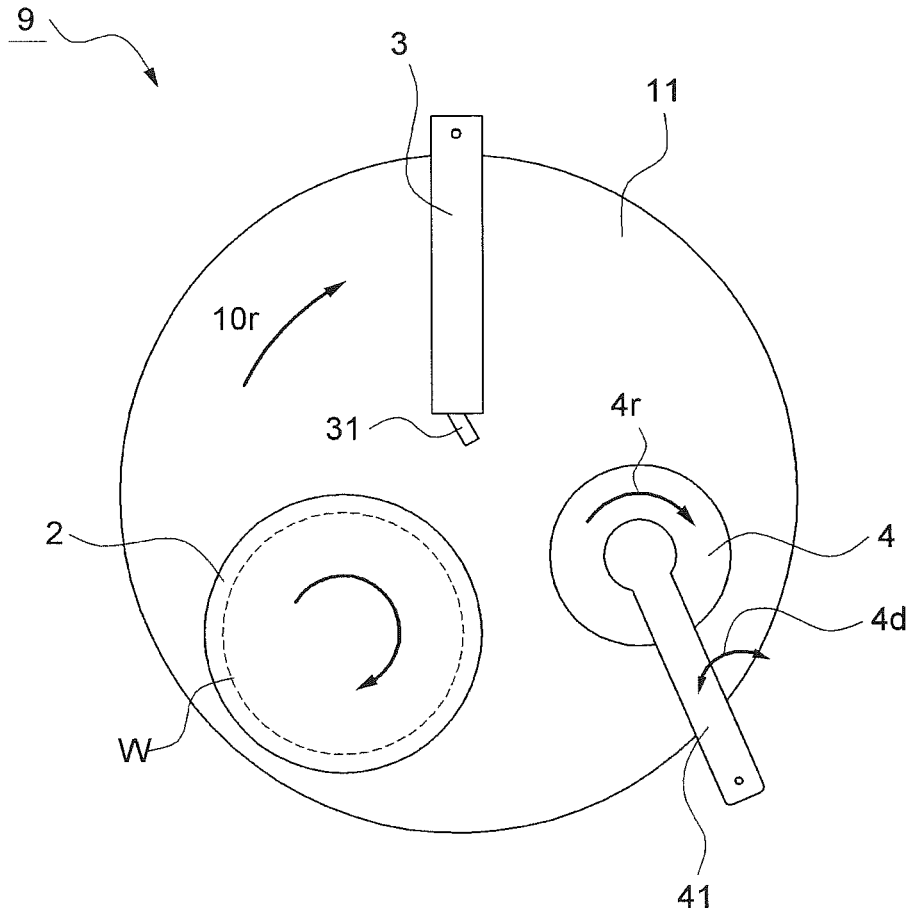
FIG. 1B is a plan view of FIG. 1A.
Figure 2:
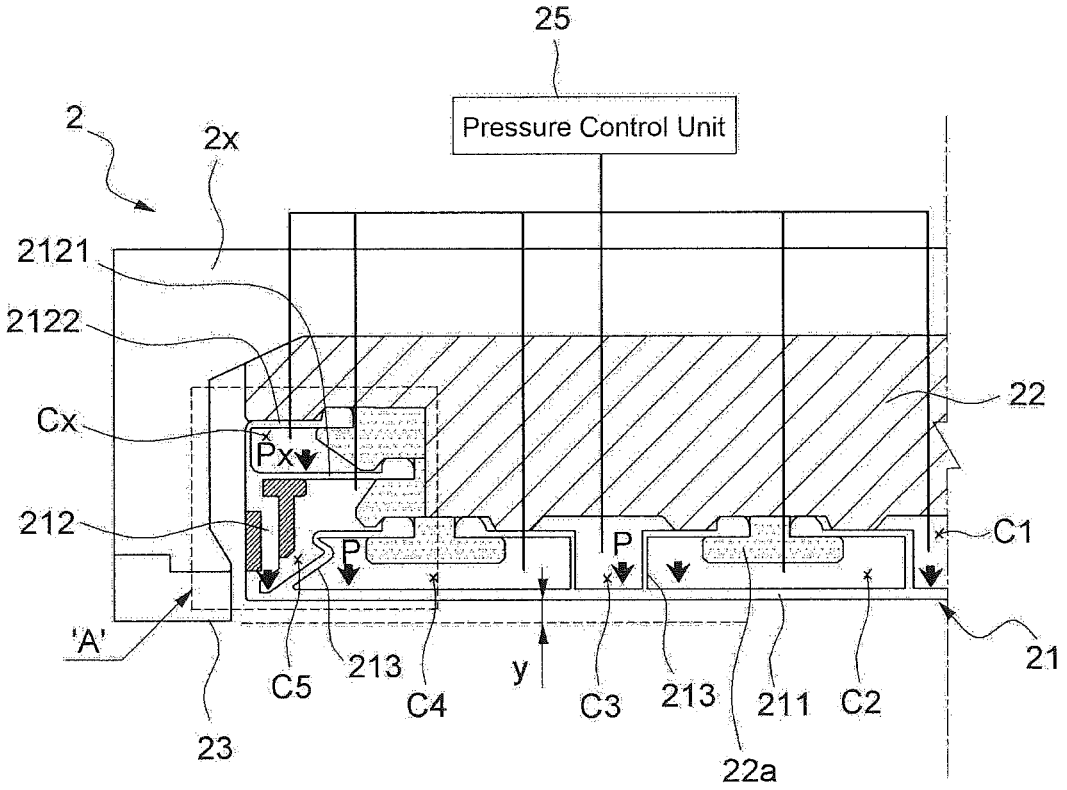
FIG. 2 is a half sectional view showing a configuration of the carrier head of FIG. 1A
Figure 3A:
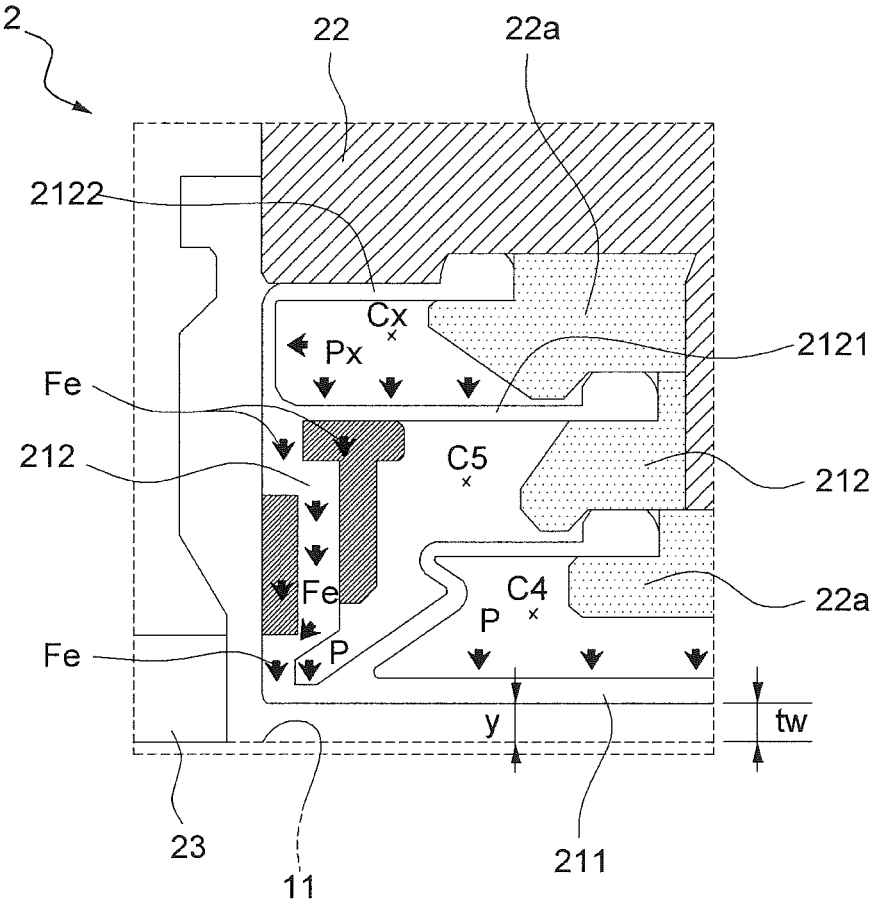
FIG. 3A is an enlarged view of a portion 'A' in FIG. 2 for showing a state in which the membrane has a predetermined shape in the polishing process as a reference position of the membrane.
Figure 3B:
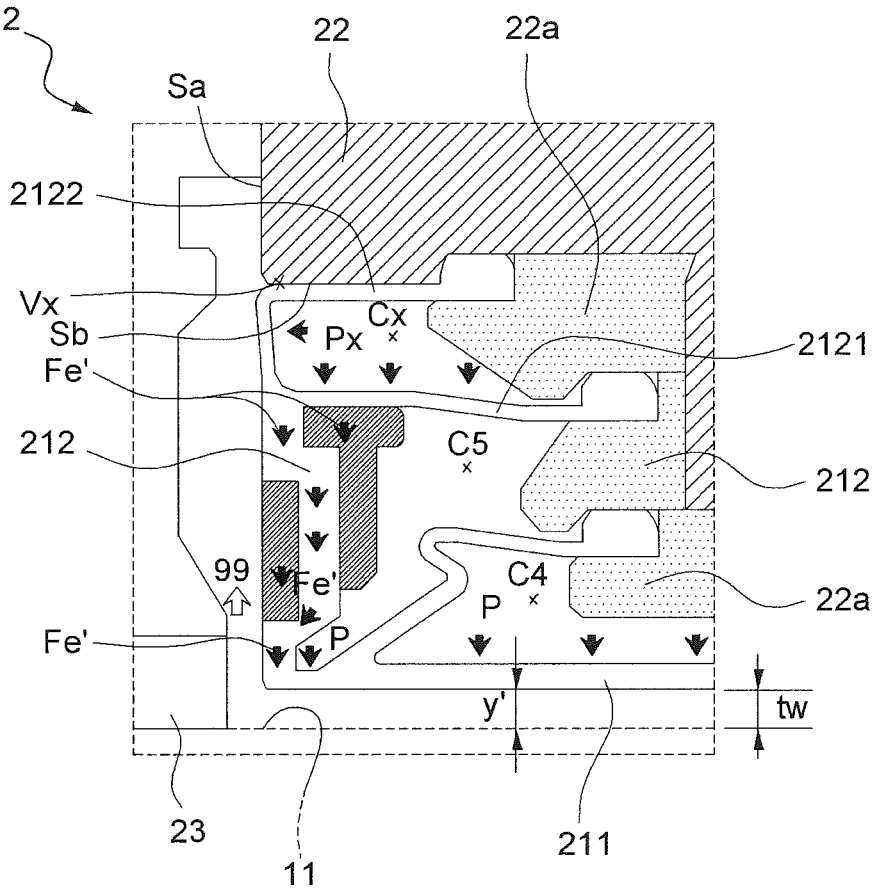
FIG. 3B is an enlarged view of a portion 'A' in FIG. 2 for showing a state in which the membrane is lifted upward due to wear of the retainer ring.
Figure 4:
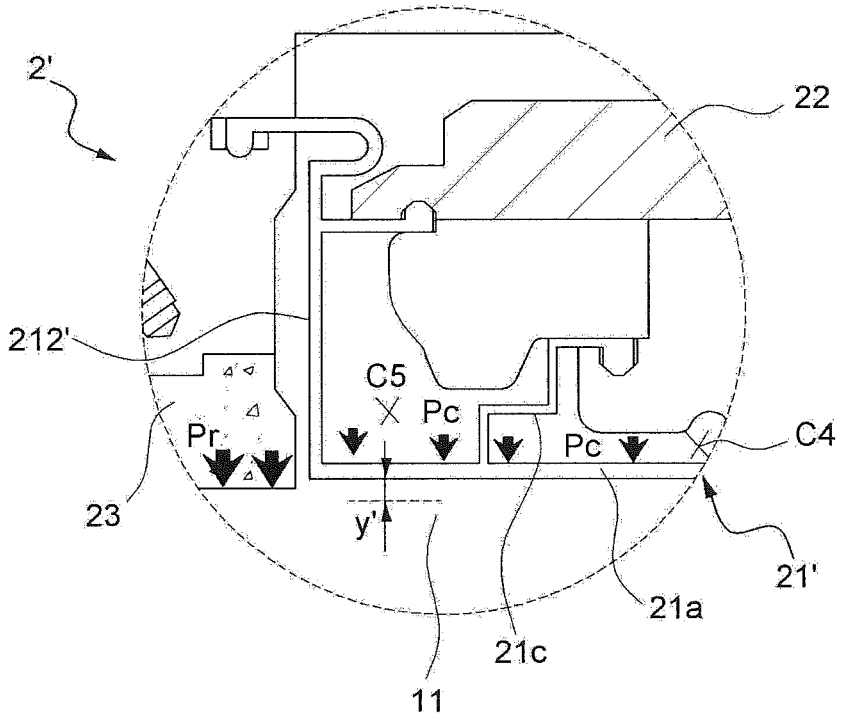
FIG. 4 is an enlarged view showing the configuration of an edge portion of another type of carrier head.

The entire shape is not shown in the drawing, but is formed in a structure in which the shape as shown in the half sectional view shown in FIG. 2 is rotated by 360 degrees.

The base 22 is integrally formed with the main body 2*x* or connected with a connecting member (not shown) to the main body 2*x*, and rotates together with the main body 2*x* by the rotational driving force transmitted from the outside during the polishing process. Thus, the membrane 101 fixed to at least one of the base 22 and the main body 2*x* and the retainer ring 23 rotate together.

The retainer ring 23 is formed as a ring shape surrounding the periphery of the bottom portion 110 of the membrane 101. The bottom surface of the retainer ring 23 is kept in contact with the polishing pad 11 during the polishing process so that the substrate located below the membrane bottom portion 110 cannot be escaped is released to the outside of the carrier head 201 during the polishing process.

The retainer ring 23 is integrally formed on the main body 2*x* of the carrier head 201 so that the bottom surface of the retainer ring 23 is maintained in contact with the polishing pad 11 by vertical movement of the carrier head 201 and vertical movement of the polishing platen 10. Alternatively, a separate control pressure chamber may be formed on the upper side of the retainer ring 23, and when a positive pressure is supplied to the control pressure chamber, the retainer ring 23 moves downward so that its bottom surface is in contact with the upper surface of the polishing pad 11.

As shown in FIG. 7, the membrane 101 includes a membrane bottom portion 110 for positioning the substrate Win contact with its bottom surface during the polishing process, and a membrane side portion 120 extending upwards from the edge of the membrane bottom portion 110, and a plurality of ring-shaped partition flaps 131, 132, 133, 134; 130 extending upwardly from the bottom portion 110 between the center of the membrane bottom portion 110 and the membrane side portion 120 to be coupled to the base 22.

The ends of the partition flaps 130 are fixed at the end via at the base 22 by the engaging member 22*a* so that a plurality of main pressure chambers C1, C2, C3, C4 and C5 are formed. As shown in FIG. 7, the partition flap 130 may be formed as a plurality of concentric rings extending from the membrane bottom portion 110 having the center of the bottom portion 110 as their common centers.

The first fixing flap 121 extends inward from the upper part of the membrane side portion 120 so that the end 121*e* of the first fixing flap 121 is fixed to the base 22 with the engaging members 22*a*. The second fixing flap 122 extends upwardly at the upper part of the membrane side portion 120.

The membrane bottom portion 110 is entirely formed of a flexible material and is freely elongated or deformed according to the pressure of the main pressure chambers C1, C2, C3, C4, and C5. When a positive pressure is applied to the main pressure chambers C1, C2, C3, C4 and C5, the membrane bottom portion 110 moves downwards as a whole. When a negative pressure is applied to the main pressure chambers C1, C2, C3, C4 and C5, the membrane bottom portion 110 moves upwards as a whole.

The membrane partition flaps 130 are also formed of a flexible material and is freely elongated or bent according to the pressure of the pressure chambers C1, . . . , C5. The membrane side portion 120 is formed of a flexible material except for the ring-shaped fixtures 120*i* and 120*e* so that the membrane side portion 120 except the ring-shaped fixtures 120*i* and 120*e* is freely elongated or bent in accordance with the pressures of the outermost pressure chamber C5 and auxiliary pressure chamber Cx. The ring-shaped fixtures 120*i* and 120*e* are formed of a material such as plastic, resin, metal or the like having a higher stiffness than the flexible material forming the bottom portion 110 and the partition flaps 130.

Generally, flexible materials are all formed of the same material, but the present invention is not limited thereto, and may be formed of two or more different flexible materials depending on the position. Here, the flexible material may be selected from any of various materials such as a polyurethane-based material or a rubber-based material.

As described above, when the ring-shaped fixtures 120*i* and 120*e* are coupled to the membrane side portion 120, the bending rigidity in the horizontal direction is reinforced so that the convex deformation of the membrane side portion 120 is reduced or prevented. That is, the side area of the side portion 120 is reinforced with the ring-shaped fixtures 120*i* and 120*e* and has high rigidity compared with the area formed only by the flexible material. Thus, Therefore, even if the pressure of the outermost pressure chamber C5 and the pressure of the auxiliary pressure chamber Cx are increased, as the bending deformation of the side area is constrained by the ring-shaped fixtures 120*i* and 120*e*, the bending deformation of the region made of a flexible material around the ring-shaped fixtures 120*i* and 120*e* is further generated.

Figure 8:
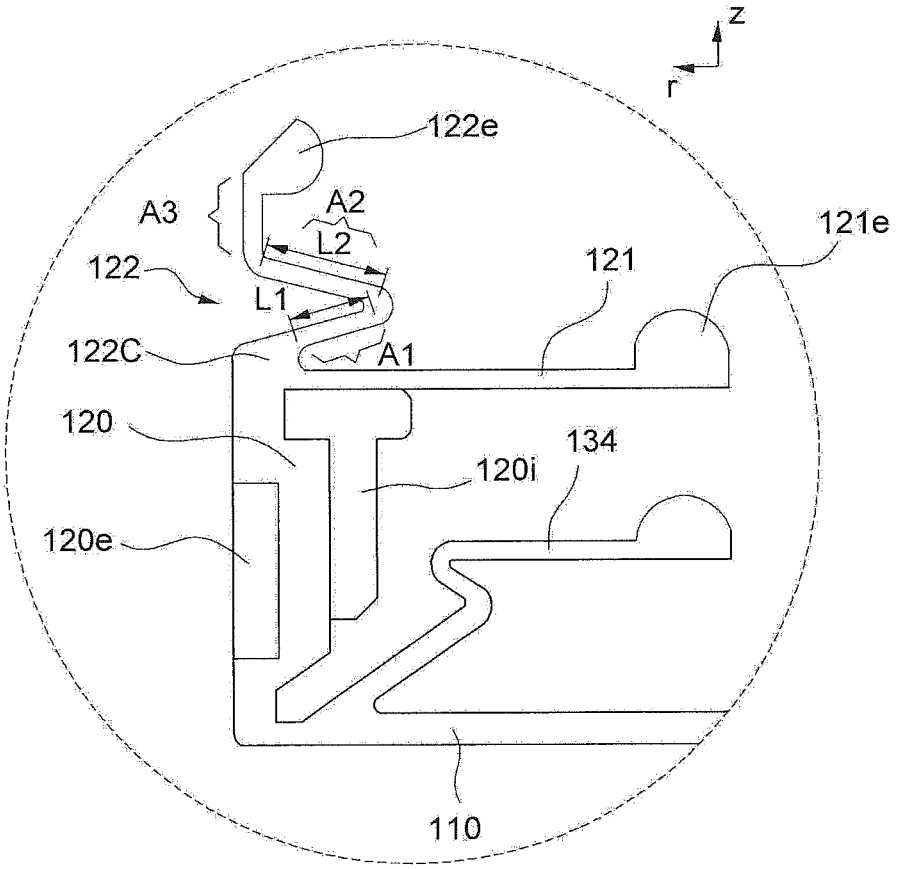
FIG. 8 is an enlarged view of a portion 'B' in FIG. 7.

As shown in FIG. 8 and FIG. 9A, a first fixing flap 121 of flexible material extends from the upper part of the membrane side portion 120 toward the base 22. A second fixing flap 122 of a flexible material extends from the upper part of the membrane side portion 120 upwards in the form of an inclined part (i.e., a wrinkle portion). It is desirable to form the first fixing flap 121 and the second fixing flap 122 of a flexible material. The ends 121*e* and 122*e* of the first fixing flap 121 and the second fixing flap 122 are fixed to the base 22 so that the space surrounded by the first fixing flap 121, the second fixing flap 122 and the base 22 forms the auxiliary pressure chamber Cx.

The second fixing flap 122 is formed of a flexible material and includes an inclined part extending upwards with inclination from the upper part of the membrane side portion 120 and a third extending part A3 extending upwards which is connected with the inclined part. In the embodiment illustrated in the drawing, the inclined part has a first inclined part A1 formed to be inclined radially inwards and upwards, a second inclined part A2 formed to be inclined radially outwards and upwards, and a third extending part A3 formed to extend upwards from the second inclined part A2 located on the upper of the first inclined part A1.

The third extending part A3 is formed to surround at least the part of the outer surface Sa of the base 22. The end of the second fixing flap 122 as the end of the third extending part A3 is fixed by the engaging member 22*a* to either the outer surface Sa or groove on the outer surface Sa of the base 22. Thus the auxiliary pressure chamber Cx is formed in a space surrounded by the first fixing flap 121 and the second fixing flap 122 on the upper side of the outermost main pressure chamber C5.

In the illustrated embodiments, the first inclined part A1 and the second inclined part A2 are formed in a straight plane, however, according to another embodiment of the present invention, the first inclined part A1 and the second inclined part A2 may be formed of any one of a flat surface, a curved surface and their combined surface. In the embodiments illustrated in the drawings, the first inclined part A1 and the second inclined part A2 are formed in an inclined form as a whole, however, according to another embodiment of the present invention, at least one of the first inclined part A1 and the second inclined part A2 may be formed only partially in an inclined shape.

The pressure control unit 25 supplies gas or air to the auxiliary pressure chamber Cx during the polishing process, so that the auxiliary pressure chamber Cx has a predetermined pressure Px. Here, the predetermined pressure Px may be a fixed value or a variable value varying in a predetermined pattern during the polishing process or a variable value varying in accordance with the measured value during the polishing process.

When air pressure is supplied to the auxiliary pressure chamber Cx, a force perpendicular to the inner wall surface of the auxiliary pressure chamber Cx acts. Thus, as shown in FIG. 9A, the force indicated by F1 acts upwardly inclining on the first inclined part A1, and the force indicated by F2 acts downwardly inclining on the second inclined part A2. When the membrane side portion 120 moves in the vertical direction, the first force F1 and the second force F2 is changed in accordance with the rotational displacement of the first inclined part A1 and the second inclined part A2. Also, a compensation force Fr determined by the normal (vertical) component of the first force F1 and of the second force F2 acts in vertical direction to the membrane side portion 120.

There may be a force at the reference position acting upward or downward by the first force F1 and the second force F2 acting on the first inclined part A1 and the second inclined part A2, it is defined in this specification and claims as referring to a force acting upward or downward in addition to the force acting at the reference position.

For example, The vertical component (i.e., the compensation force) of the forces F1 and F2 acting on the first inclined part A1 and the second inclined part A2 at the "reference position" before the wear of the retainer ring 23 or the polishing pad 11 may be set to be '0'. Alternatively, considering the magnitude of the pressing force Fe transmitted to the substrate edge through the membrane side portion 120 by the pressure Px of the auxiliary pressure chamber Cx, the vertical component (i.e., the compensation force) of the forces F1 and F2 at the "reference position" acting on the first inclined part A1 and the second inclined part A2 may be set to a value other than '0'.

The 'pre-wear state' of the retainer ring 23 and the polishing pad 11 is not limited to a state in which the retainer ring or the polishing pad is mounted for the first time, and refers to any state to be compared with the 'after wear state'. For convenience, the reference position of the membrane 101 shown in FIG. 9A is shown with the first fixing flap 121 extending horizontally, but the present invention is not limited thereto.

Hereinafter, for convenience of explanation, it is assumed that the vertical component of the forces F1 and F2 acting on the first inclined part A1 and the second inclined part A2 at the 'reference position' is '0'

Most of all, the end 122*e* of the second fixing flap 122 is not fixed to the bottom surface Sb of the base 22, as the third extending part A3 extends upward. Instead, the end 122*e* of the second fixing flap 122 is formed in the third extending part A3 and fixed to the outer surface Sa of the base 22.

Figure 5:
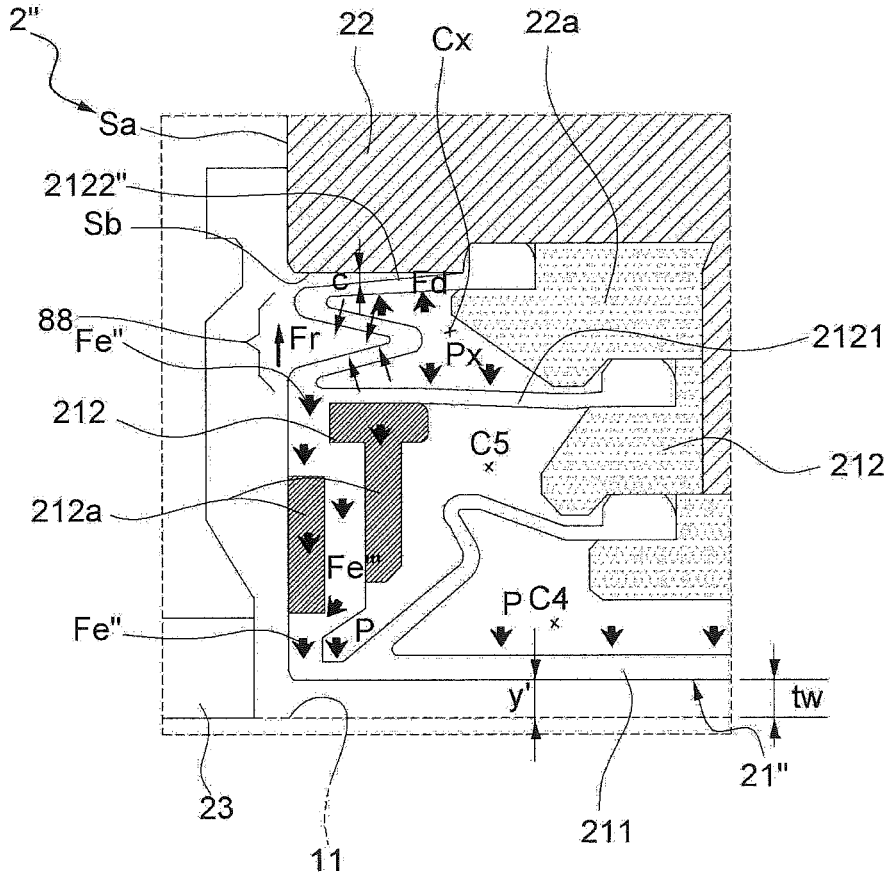
FIG. 5 is an enlarged view showing the configuration of an edge portion of another type of carrier head.

That is, a curved path from the top of the membrane side portion 120 to the end 122*e* of the second fixing flap 122 is much shorter than that of membrane 21" shown in FIG. 5. Thus, the membrane side portion 120 and the second fixing flap 122 have a higher rigidity against the twisting deformation due to the rotation of the carrier head 201 and can further reduce the distortion of the side portion of the membrane 101. Also, even if centrifugal force is generated as the carrier head 201 rotates at high speed during the polishing process, as the horizontal part separated from the bottom surface of the base 22 and thus forced and lifted by upward force Fd is removed from the membrane 101.

Accordingly, the twisting deformation of the membrane side portion 120 and its adjacent portion is suppressed, and it is possible to solve the problem that the membrane bottom portion of the side portion unstably contacts with the edge portion of the substrate during the polishing process. Further, pressing force Fe is continuously and constantly applied to the edge of the substrate, the uniform polishing profile at the edge portion of the substrate in the circumferential direction can be obtained.

In addition, different from the membrane structure shown in FIG. 5 in which upward force Fd acts on the horizontal part separated from the bottom surface Sb of the base so that the membrane side portion 120 is lifted by the upward force Fd, the third extending part A3 is formed to extend upwardly and does not make any upward force to lift the membrane side portion 120 in the third extending part A3

As shown in FIG. 9B, when the retainer ring 23 is integrally fixed to the carrier head 201, as the amount of wear of the retainer ring 23 increases, the distance y between the membrane bottom portion 110 and the polishing pad 11 decreases in y' from y in FIG. 9A. Thus, the membrane 101 with the substrate positioned below the membrane for the polishing process is lifted upwards as shown FIG. 9B from the reference position in FIG. 9A.

Figure 9C:
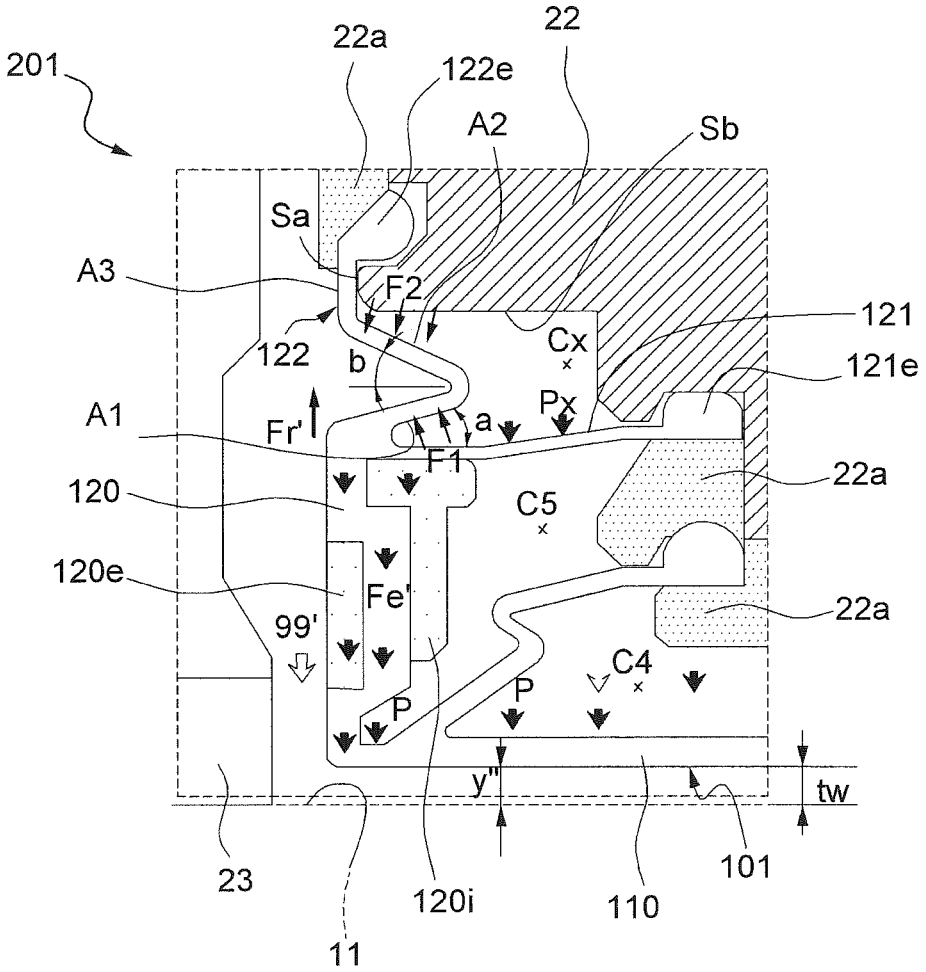

On the other hand, when the retainer ring is formed so as to be movable up and down, and when the carrier head performs the polishing process at a predetermined height, the membrane bottom portion 110, as the wear amount of the polishing pad 11 increases, as shown in FIG. 9C, the bottom distance y between the membrane bottom portion 110 and the polishing pad 11 increases to a value of y" from y in FIG. 9A. Thus, As shown in FIG. 9C, the membrane 101 with the substrate positioned below the membrane for the polishing process, moves downwards by the displacement 99' from the reference position in FIG. 9A.

As described above, when the retainer ring is integrally fixed to the carrier head, as the wear of the retainer ring 23 proceeds, the upward displacement 99 of the membrane 101 including the membrane side portion 120 becomes greater, and thus the compensating force Fr generated by the second fixing flap 122 gradually increases to act downwards. When the retainer ring is vertically movable with respect to the carrier head, as the wear of the polishing pad 11 proceeds, the downward displacement 99' of the membrane 101 including the membrane side portion 120 becomes greater, and thus the compensating force Fr generated by the second fixing flap 122 gradually increases to act upwards.

As the membrane side portion 120 moves upward or downward, the forces F1 and F2 acting on the first inclined part A1 and the second inclined part A2 of the second fixing flap 122 changes, and the compensating force Fr acting on the membrane side portion 120 is determined by the resultant force of the vertical component of the forces F1 and F2.

That is, when the membrane side portion 120 moves upwards or downwards in the vertical direction, the slope of the first inclined part A1 and the second inclined part A2 are changed in accordance with the displacement of the membrane side portion 120. Thus the compensating force Fr is introduced upward or downward due to the variation difference of the vertical component of between the first force F1 acting on the first inclined part A1 and the second force F2 acting on the second inclined part A2.

Preferably, when the membrane side portion 120 moves upwards by the upward displacement 99, the compensating force Fr acts downwards. Similarly when the membrane side portion 120 moves downwards by and the downward displacement 99', the compensating force Fr acts upwards. When the magnitude of the displacements 99 and 99' of the membrane side portion is larger, the compensating force Fr also preferably acts greater accordingly.

For this effect, the constitution of the present invention may comprise so that the second inclined part A2 of the second fixing flap 122 has a larger rotational displacement than the rotational displacement of the first inclined part A1.

For example, the second inclined part A2 may be formed to have a lower bending stiffness than the first inclined part A1. As a result, when the membrane side portion 120 moves upwards or downwards, a larger rotational displacement is generated in the second inclined part A2 than in the first inclined part A1. Here, the difference in bending stiffness between the first inclined part A1 and the second inclined part A2 may be formed of different materials, or of different thickness. For example, the second inclined part A2 is thinner than the first inclined part A1. Also, the first inclined part A1 may further include a embedded material having high bending stiffness.

In this configuration, when the upward displacement 99 is generated in the membrane side portion 120 as the wear amount of the retainer ring 23 increases, the rotational displacement of the second inclined part A2 is greater than that of the first inclined part A1. This may be expressed that the reduction rate of the angle b with the horizontal plane of the second inclined part A2 is larger than the reduction rate of the angle a with the horizontal plane of the first inclined part A1.

As a result, the amount of increase of the second force F2 acting on the second inclined part A2 is larger than the amount of increase of the first force F1 acting on the first inclined part A1. It means that the second fixing flap 122 introduces a downward compensating force Fr to the membrane side portion 120. In this case, since the downward compensating force Fr of the second fixing flap 122 is determined by the amount of the upward displacement of the membrane side portion 120, the reduction amount of the pressing force Fe' to the edge of the substrate in accordance with the upward displacement of the membrane side portion 120, is compensated by the downward compensating force Fr by the second clamping flap 122. Thus a constant pressing force is introduced to the edge portion of the substrate in spite of the vertical displacement of the membrane side portion 120.

Specifically, when the membrane side portion 120 is lifted upwards in accordance with the decrease of the bottom separation distance y by such as the wear increase of the retainer ring 23, the angle a between the first inclined part A1 and the horizontal plane tends to be maintained as it is, the angle b between the second inclined part A2 and the horizontal plane is deformed to be smaller.

That is, as shown in FIG. 10, the angle a of the first inclined part A1 with respect to the horizontal plane is maintained almost unchanged from ai to ao, and the angle b with respect to the horizontal plane of the second inclined part A2 is greatly reduced from bi to bo. In the drawing, the reference numeral A1*i* denotes the outline of the first inclined part at the reference position, and the reference numeral Ali denotes the outline of the second inclined part at the reference position.

Then, even if the same force acts on the first inclined part A1 and the second inclined part A2, the vertical component of the force F2 acting on the second inclined part A2 is greater than that of the first inclined part A1. That is, the increase amount of the vertical component of the force F2 acting on the second inclined part A2 becomes larger than the increase amount of the vertical component of the force F1 acting on the first inclined part A1. Therefore, the compensating force Fr induced by the second fixing flap 122 always acts downwards, and the magnitude of the compensating force Fr tends to increase as the moving upward displacement 99 of the membrane side portion 120 increases.

Therefore, when the wear amount of the retainer ring 23 increases and the upward displacement 99 of the membrane side portion 120 increases on the basis of the pre-wear state where the membrane is in the reference position, the downward force (i.e., the vertical component of F2) on the second inclined part A2 becomes greater that the upward force (i.e., the vertical component of F1) on the first inclined part A1. Thus the downward compensation force Fr by the second fixing flap 122 compensates the reduction of the pressing force F2' to the edge of the substrate in proportion to the upward displacement 99 of the membrane side portion 120, and the pressing force Fe' for pressing the edge portion of the substrate is kept constantly in spite of the variation of the upper displacement 99 of the membrane side portion 120.

This is similarly applied to when a downward displacement of the membrane side portion 120 occurs. When the carrier head is subjected to a polishing process at a predetermined height with allowing the retainer ring 23 to move up and down, as the wear amount of the polishing pad 11 increases, the membrane side portion 120 moves downwards by the downward displacement 99'. As a result, the rotational displacement or deflection away from the horizontal plane of the second inclined part A2 is larger than that of the first inclined part A1. This may be expressed that the increase rate of the angle b with the horizontal plane of the second inclined part A2 is larger than the increase rate of the angle a with the horizontal plane of the first inclined part A1.

Accordingly, as the decrease amount of the vertical component of the second force F2 acting on the second inclined part A2 is larger than the decrease amount of the vertical component of the first force F1 acting on the first inclined part A1, the second fixing flap 122 introduces upward compensation force Fr' to the membrane side portion 120. At this time, since the upward compensation force Fr' of the second fixing flap 122 is determined by the amount of the downward displacement amount of the membrane side portion 120, as the membrane side portion 120 moves downward, the increment of the pressing force Fe' is compensated by the upward compensation force Fr' of the second clamping flap 122 so that a pressing force is constantly introduced into the edge portion of the substrate.

Concretely, when the carrier head 201 performs the polishing process at a predetermined height and the retainer ring 23 is vertically movable by the retainer chamber, as the wear amount of the polishing pad 11 increases, the separation distance (y) increases. As shown in FIG. 9C, when the bottom separation distance y increases to y", a downward displacement 99' of the membrane side portion 120 is generated to pushed downwards. In this case, Since the bending stiffness of the bending connection is smaller than the that of the first connection part 122*c*, the angle a formed by the first inclined part A1 with the horizontal plane tends to be maintained as it is whereas the angle b formed by the second inclined part A2 with the horizontal plane is deformed to be larger.

When the angle a with respect to the horizontal plane of the first inclined part A1 is maintained and the angle b with respect to the horizontal plane of the second inclined part A2 is reduced, although the same force is applied to the first inclined part A1 and the second inclined part A2, the vertical component of the force F2 acting on the second inclined part A2 becomes smaller than the vertical component of the force F1 acting on the first inclined part A1. Accordingly, the compensating force Fr acting on the second fixing flap 122 acts upwards in accordance with the downward displacement of the membrane side portion 120, the pressing force to the edge of the substrate can be maintained constantly regardless of the downward displacement of the membrane side portion 120.

As above, based on the reference position in which the membrane is prior-wear state, if the wear amount of the retainer ring 23 or the polishing pad 11 varies and if the membrane side portion 120 moves upwards or downwards by the displacement 99, 99', the variation of the vertical component of the downward force F2 on the second inclined part A2 becomes larger than the variation of the vertical component of the upward force F1 on the first inclined part A1.

That is, the compensating force Fr by the second fixing flap 122 acts in a direction opposite to the direction of the displacement of the membrane side portion 120, and acts in proportion to the magnitude of the displacement of the membrane side portion 120. Therefore, by compensating the variation of the pressing force Fe' of pressing the edge portion of the substrate by the compensating force Fr by the second clamping flap 122, even when the vertical movement displacements 99 or 99' of the membrane side portion 120 occurs, a constant pressing force can be applied to the edge of the substrate to improve the polishing quality.

On the other hand, in the case that the bending stiffness of the first inclined part A1 and the second inclined part A2 is very low, excessive downward concave deflection may occurs in the second inclined part A2 when positive pressure is applied to the auxiliary pressure chamber Cx, which may distort the magnitude of the intended compensation force Fr, Fr'. Therefore, when the bending stiffness of the first inclined part A1 and the second inclined part A2 is extremely low, the bending stiffness of the bending connection portions between the first inclined part A1 and the second inclined part A2 may be set to be over the average bending stiffness of the inclined part A1 and the second inclined part A2.

On the other hand, as shown in FIG. 8, it is desirable that the length L2 of the second inclined part A2 of the second fixing flap 122 may be longer than the length L1 of the first inclined part A1.

Thus, although the forces acting on the first inclined part A1 and the second inclined part A2 in the vertical direction by the pressure of the auxiliary pressure chamber Cx at the reference position are stable equilibrium with each other, when the wear amount of retainer ring 23 increases and the displacement amount of the membrane side portion 120 upwards from the reference position increases, the inclined part including the first inclined part A1 and the second inclined part A2 generates a downward compensating force (Fr).

More specifically, when the wear amount of the retainer ring 23 increases and the amount of upward displacement of the membrane side portion 120 from the reference position increases, although the rotational displacements of the first inclined part A1 and the second inclined part A2 are the same each other, as the length L2 of the second inclined portion A2 is longer than that of the first inclined part A1, the increment of the vertical component of force F2 on the second inclined part A2 is greater than that of force F1 on the first inclined part A1.

Similar to inducing a larger rotational displacement of the second inclined part A2 relative to the first inclined part A1, this is to obtain an advantageous effect to induce the compensation force in opposite direction to the upward or downward displacement of the membrane side portion 120.

On the other hand, in order to improve the above-mentioned operation effect, compared with the angle of the first inclined part A1 in the second fixing flap 122 with the horizontal plane, for example a plane in which the first fixing flap extends horizontally, it is preferable that the angle b of the second inclined part A2 with the horizontal plane is smaller.

As a result, although the vertical component of forces acting on the first inclined part A1 and the second inclined part A2 by the pressure of the auxiliary pressure chamber Cx at the reference position are equilibrated each other, when the wear amount of retainer ring 23 increases and the upward displacement amount of the membrane side portion 120 from the reference position increases, and if the angle b of the second inclined part A2 with the horizontal plane and the angle a of the first inclined part A1 with the horizontal plane decrease by the same amount, as the increment of cosine component of force F2 on the second inclined part A2 increase more, the winkled portion can make greater amount of the downward compensation force to the membrane side portion 120.

On the other hand, the first connection part 122*c* at which the first inclined part A1 and the upper part of the membrane side portion 120 are connected may have greater stiffness compared with the an average stiffness of at least one of the first inclined part A1 and the second inclined part A2.

Thus, when the compensation force Fr by the second fixing flap 122 acts downwards, the first connection part 122*c* maintains its shape instead of being bent, the compensation force is reliable applied to push the membrane side portion 120 downwards.

Here, in order to increase the stiffness of the first connection part 122*c*, as shown in the figure, it may be made formed as thicker than the average thickness of at least one of the first inclined part A1 and the second inclined part A2. Although not shown in the drawing, the stiffness can be increased by forming a material having high rigidity together with the first connecting part 122*c*.

Hereinafter, referring to FIG. 11, the carrier head 202 and membrane 102 used therein for a polishing apparatus according to the second embodiment of the present invention will be described in detail. It should be noted, however, that the same or similar reference numerals are given to the same or similar components and functions as those of the first embodiment described above, and a description thereof will be omitted in order to clarify the gist of the second embodiment of the present invention.

The membrane 102 of the carrier head 202 shown in FIG. 11 is formed such that the second fixing flap 222 extends from the first fixing flap 121 instead of extending from the upper part of the membrane side portion 120, which is different from the configuration of the first embodiment.

That is, the first fixing flap 121 is extended inward. The end 121*e* of the first end flap 121 is fixed to the base 22 by the engaging member 22*a*. The second fixing flap 122 extends upwards from the first fixing flap 121 spaced inwardly by Le from the upper end of the membrane side portion 120.

Here, the second fixing flap 222 includes a first inclined part A1 formed to be inclined radially inwardly and upwardly from the membrane side portion 120, a second inclined part A2 formed to be inclined radially outward and upwardly, and a third extending part A3 connected to the second inclined part A2 and extends upwardly to be fixed to the side surface of the base 22.

As the second fixing flap 222 extends from the first fixing flap 121, the first inclined part A1 is formed to have a shorter length than the second inclined part A2. Similar to the configuration of the first embodiment described above, the angle formed by the first inclined portion A1 with the horizontal plane is larger than the angle formed by the second inclined portion A2 with the horizontal plane. In addition, the first inclined part A1 and the first connecting portion 122*c* of the first fixing flap 121 have higher rigidity than the average fixing flap 121.

The end of the third extending part A3 is fixed to the outer surface Sa of the base 22 so as not to affect the vertical compensation force Fr by the second fixing flap 222, which suppresses the twisting deformation of the membrane in spite of high speed rotation during the polishing process.

Similar to the first embodiment of the present invention, the second fixing flap A2 is configured such that, when the membrane side portion 120 moved upwards or downwards, the rotational displacement of the second inclined part A2 is greater than that of the first inclined part A1. Also, the length of the second inclined part A2 of the second fixing flap 122 may be longer than that of the first inclined part A1.

As a result, when the wear amount of the retainer ring 23 increases and the bottom separation distance y' decreases as compared with the wear state of the retainer ring 23 at the reference position, the increment of the vertical component of the force F2 on the second inclined part A2 is greater than that of the force F1 on the first inclined part A1 and thus downward compensation force Fr is applied by to the membrane side portion 120 the second fixing flap 222.

Similarly, although not shown in the drawing, when the wear amount of the polishing pad 11 increases and the bottom separation distance y' increases as compared with the wear state of the polishing pad 11 at the reference position, the decrement of the vertical component of the force F2 on the second inclined part A2 is greater than that of the force F1 on the first inclined part A1 and thus upward compensation force is applied to the membrane side portion 120 by the second fixing flap 222.

Figure 6:
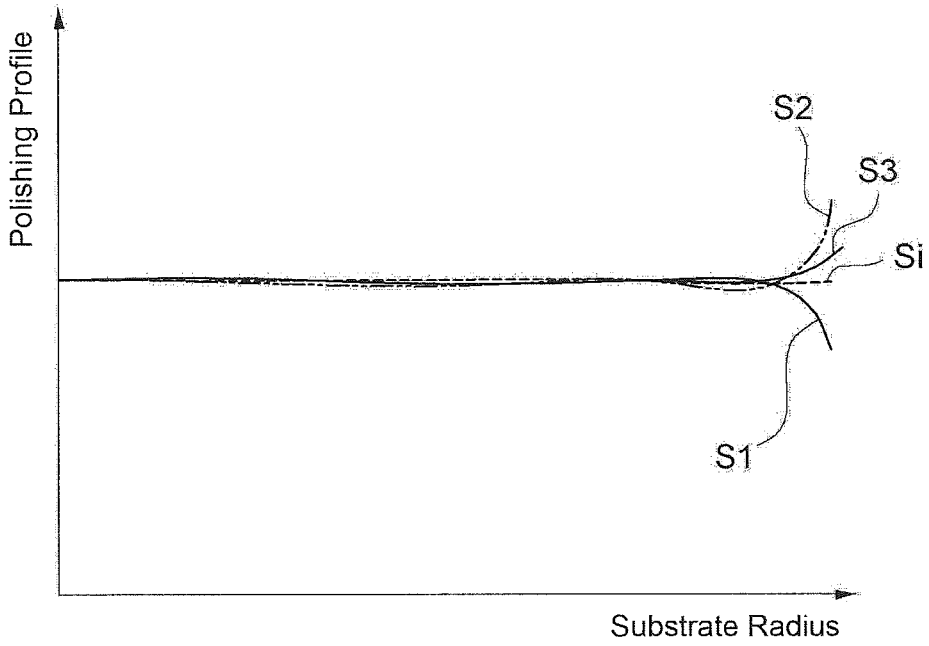
FIG. 6 is a graph showing the polishing profile of the substrate according to the membrane structure.

Even if the wear of the consumables such as retainer ring 23 and/or the polishing pad 11 proceeds to cause the upward or downward displacement 99 of the membrane side portion 120 as the polishing process is repeated, the pressing force Fe' acting on the edge portion is compensated and kept almost constant by the compensating force Fr acting in the direction opposite to the moving direction of the side surface 120 by the second engaging flap 222. Accordingly, it is possible to obtain the effect of maintaining the polishing quality of the edge of the substrate regardless of the wear state of the retainer ring 23 such that the polishing profile indicated by Si in FIG. 6 is obtained.

Hereinafter, referring to FIG. 12, the carrier head 203 and the membrane 103 used therein of the polishing apparatus according to the third embodiment of the present invention will be described in detail. It should be noted, however, that the same or similar reference numerals are given to the same or similar components and operations as those of the first embodiment described above, and a description thereof will be omitted in order to clarify the gist of the third embodiment of the present invention.

The membrane 103 of the carrier head 203 shown in FIG. 12 is different from the membrane in the first embodiment in that the end of the second fixing flap 322 is fixed at the boundary corner portion of the outer surface Sa and the bottom surface Sb.

For this, the second fixing flap 322 does not have a third extending part, and the end 322*e* of the second fixing flap 322 is formed at the end of the second inclined part A2. The end 322*e* of the second fixing flap 322 is fixed at the base corner (i.e., edge portion of boundary between the outer surface Sa and the bottom surface Sb of the base 22) with the engaging member 22*a* engaged with the base 22.

A first fixing flap 121 extends inward at an upper part of the membrane side portion 120 and an end 121*e* thereof is fixed to the base 22 by the engaging member 22*a*. The second fixing flap 322 extends upward from the first fixing flap 121 spaced inwardly by Le from the upper part of the membrane side portion. However, the third embodiment of the present invention is configured such that the second fixing flap 322 extends directly from the first fixing flap 121, but the present invention is not limited to this, and similarly to the first embodiment, the second fixing flap 322 may be formed to extend directly from the upper part of the membrane side portion 120.

The second fixing flap 322 includes a first inclined part A1 inclined radially inwards and upwards from the first fixing flap 121 and a second inclined part A2 inclined upwards and radially outwards from the first inclined part A1.

As the second fixing flap 322 extends from the first fixing flap 121, the first inclined part A1 is formed to have a shorter length than the second inclined part A2. As described in the first embodiment of the present invention, the angle of the first inclined portion A1 with the horizontal plane is larger than the angle of the second inclined portion A2 with the horizontal plane. The first inclined part A1 and the first connecting part 122*c* of the first fixing flap 121 are formed to have higher stiffness than the first fixing flap 121.

Similar to the first embodiment of the present invention, the second fixing flap 322 is configured such that, when the membrane side portion 120 moved upwards or downwards, the rotational displacement of the second inclined part A2 is greater than that of the first inclined part A1. Also, the length of the second inclined part A2 of the second fixing flap 122 may be longer than that of the first inclined part A1.

Also, the membrane 103 in accordance with the third embodiment of the present invention does not include the third extending part A3, the compensation force in vertical direction is determined by the shape of the first inclined part A1 and the second inclined part A2. Also, as the length of the second fixing flap is short, the twisting distortion is suppressed in spite of high-speed rotation of the carrier head.

As a result, when the wear amount of the retainer ring 23 increases and the bottom separation distance y' decreases as compared with the wear state of the retainer ring 23 at the reference position, the increment of the vertical component of the force F2 on the second inclined part A2 is greater than that of the force F1 on the first inclined part A1 and thus downward compensation force Fr is applied to the membrane side portion 120 by the second fixing flap 322.

Similarly, although not shown in the drawing, when the wear amount of the polishing pad 11 increases and the bottom separation distance y' increases as compared with the wear state of the polishing pad 11 at the reference position, the decrement of the vertical component of the force F2 on the second inclined part A2 is greater than that of the force F1 on the first inclined part A1 and thus upward compensation force is applied to the membrane side portion 120 by the second fixing flap 322.

Accordingly, even if the wear of consumables such as the retainer ring 23 and/or the polishing pad 11 proceeds to cause the upward displacement 99 of the membrane side portion 120 as the polishing process is repeated, the pressing force Fe' acting on the edge portion is compensated and kept constant by the downward compensating force Fr. Therefore, it is possible to obtain the effect of maintaining the polishing quality of the edge of the substrate regardless of the wear state of the retainer ring 23 such that the polishing profile indicated by Si in FIG. 6 is obtained.

Hereinafter, referring to FIG. 13, the carrier head 204 and membrane 104 used therein for a polishing apparatus according to the fourth embodiment of the present invention will be described in detail. It should be noted, however, that the same or similar reference numerals are given to the same or similar components and functions as those of the first embodiment described above, and a description thereof will be omitted in order to clarify the gist of the second embodiment of the present invention.

The membrane 104 of the carrier head 204 shown in FIG. 13, different from the first embodiment of the present invention, is formed such that the end of the second fixing flap 422 is fixed at the inner circumferential surface Sd of the retainer ring 23 instead of the outer surface Sa of the base. Also, A third fixing flap (not shown) connecting the outer surface Sa of the base 22 and the inner circumferential surface Sd of the retainer ring 23 is provided over the second fixing flap 422, and thus an auxiliary pressure chamber Cx is formed as surrounded by the first fixing flap 121, the base 22, the second fixing flap 422 and the third fixing flap.

Similar to the third embodiment of the present invention, the second fixing flap 422 does not have a third extending part, and the end 422*e* of the second fixing flap 422 is formed at the end of the second inclined part A2. The end 422*e* of the second fixing flap 422 is fixed at the inner circumferential surface Sd of the retainer ring 23.

Herein, the second fixing flap 422 includes a first inclined part A1 inclined radially inwards and upwards from the upper part of the membrane side portion 120 and a second inclined part A2 inclined upwards and radially outwards from the first inclined part A1.

As the second inclined part A2 of the second fixing flap 422 is fixed at the inner circumferential surface Sd, the first inclined part A1 is formed to have a shorter length than the second inclined part A2. As described in the first embodiment of the present invention, the angle of the first inclined portion A1 with the horizontal plane is larger than the angle of the second inclined portion A2 with the horizontal plane. The first inclined part A1 and the first connecting part 122*c* of the first fixing flap 121 are formed to have higher stiffness than the first fixing flap 121.

Similar to the first embodiment of the present invention, the second fixing flap 422 is configured such that, when the membrane side portion 120 moved upwards or downwards, the rotational displacement of the second inclined part A2 is greater than that of the first inclined part A1. Also, the length of the second inclined part A2 of the second fixing flap 122 may be longer than that of the first inclined part A1.

Also, the membrane 104 in accordance with the fourth embodiment of the present invention does not include the third extending part A3, the compensation force in vertical direction is determined by the shape of the first inclined part A1 and the second inclined part A2. Also, as the length of the second fixing flap is short, the twisting distortion is suppressed in spite of high-speed rotation of the carrier head.

As a result, when the wear amount of the retainer ring 23 increases and the bottom separation distance y' decreases as compared with the wear state of the retainer ring 23 at the reference position, the increment of the vertical component of the force F2 on the second inclined part A2 is greater than that of the force F1 on the first inclined part A1 and thus downward compensation force Fr is applied to the membrane side portion 120 by the second fixing flap 422.

Similarly, although not shown in the drawing, when the wear amount of the polishing pad 11 increases and the bottom separation distance y' increases as compared with the wear state of the polishing pad 11 at the reference position, the decrement of the vertical component of the force F2 on the second inclined part A2 is greater than that of the force F1 on the first inclined part A1 and thus upward compensation force is applied to the membrane side portion 120 by the second fixing flap 422.

Accordingly, even if the wear of consumables such as the retainer ring 23 and/or the polishing pad 11 causes to gradually increase the upward displacement 99 of the membrane side portion 120 as the polishing process is repeated, the pressing force Fe' acting on the edge portion of the substrate is compensated and kept constant by the gradually increased downward compensating force Fr. Therefore, it is possible to obtain the effect of maintaining the polishing quality of the edge of the substrate regardless of the wear state of the retainer ring 23 such that the polishing profile indicated by Si in FIG. 6 is obtained.

Hereinafter, referring to FIG. 14, the carrier head 205 and membrane 105 used therein for a polishing apparatus according to the fifth embodiment of the present invention will be described in detail. It should be noted, however, that the same or similar reference numerals are given to the same or similar components and functions as those of the first embodiment described above, and a description thereof will be omitted in order to clarify the gist of the second embodiment of the present invention.

The membrane 105 of the carrier head 205 shown in FIG. 14, different from the first embodiment of the present invention, is formed such that the third extending part A3 is formed long enough to cover the outer surface Sa of the base 22 and the end 522*e* of the third extending part A3 is fixed at the upper surface Sc of the base 22.

As above, as the second fixing flap 522 is installed as a shape of the outer surface Sa of the base and the end thereof is fixed on the upper surface Sc of the base, the fifth embodiment of the present invention realize the advantageous effects of the first embodiment and simultaneously obtain an advantageous effect of more easily fixing the second fixing flap 522 to the base 22.

Hereinafter, referring to FIG. 16, the membrane 105 used in a carrier head for a polishing apparatus according to the sixth embodiment of the present invention will be described in detail. It should be noted, however, that the same or similar reference numerals are given to the same or similar components and functions as those of the first embodiment described above, and a description thereof will be omitted in order to clarify the gist of the second embodiment of the present invention.

According to the sixth embodiment of the present invention, as shown in FIG. 15, the membrane 106 of a carrier head includes a plurality of first inclined parts A1, A5 in the second fixing flap 622 and a plurality of second inclined parts A2, A6. That is, the wrinkle portion includes the plurality of first inclined parts A1, A5 and the plurality of second inclined parts A2, A6.

That is, the first inclined portions A1 and A5 inclined radially inwardly and upwardly with respect to the membrane bottom portion 110 in two places in the second fixing flap 622. The second inclined portions A2 and A6 inclined radially outwardly and upwardly with respect to the membrane bottom portion 110 in two places in the second fixing flap 622. Thus, the first force F1 is determined by the resultant force of the forces acting on the two first inclined portions A1 and A5 And the second force F2 is determined by the resultant force of the forces acting on the two second inclined portions A2 and A6.

Herein, when the retainer ring 23 is integrally fixed to the main body 2*x* of the carrier head, if the wear amount of the retainer ring 23 increases and the upward displacement 99 of the membrane side portion 120 increases, the shape of the second fixing flap 622 is determined such that the increment of the vertical component of the resultant force by the second forces F2 is greater than the increment of the vertical component of the resultant force by the first forces F1.

As described in the first embodiment of the present invention, the first inclined parts A1, A5 and the second inclined parts A2, A6 may be formed such that the rotational displacement of the second inclined parts A2, A6 is generated greater than that of the first inclined parts A1, A5, when the membrane side portion 120 moves upwards or downwards. Also, as described in the first embodiment, the sum of the length of the second inclined parts A2, A6 is greater than that of the first inclined parts A1, A5.

As a result, when the wear amount of the retainer ring 23 increases as compared with the wear state of the retainer ring 23 at the reference position and the membrane side portion 120 moves upwards by the wear amount of the retainer ring 23, as the increment of the vertical component of the resultant force of the second force F2 on the second inclined parts A2, A6 is greater than that of the first force F1 on the first inclined parts A1, A5 and thus downward compensation force Fr is applied to the membrane side portion 120 by the second fixing flap 622.

Similarly, when the wear amount of the polishing pad 11 increases as compared with the wear state of the polishing pad 11 at the reference position and the membrane side portion 120 moves downwards, the decrement of the vertical component of the resultant force of the second force F2 on the second inclined parts A2, A6 is greater than that of the first force F1 on the first inclined parts A1, A5 and thus upward compensation force is applied to the membrane side portion 120 by the second fixing flap 622.

Accordingly, even if the wear of consumables such as the retainer ring 23 and/or the polishing pad 11 causes to gradually increase the upward or downward displacement of the membrane side portion 120 as the polishing process is repeated, the pressing force acting on the edge portion of the substrate is compensated and kept constant by the gradually increased downward or upward compensating force. Therefore, it is possible to obtain the effect of maintaining the polishing quality of the edge of the substrate regardless of the wear state of the consumables such that the polishing profile indicated by Si in FIG. 6 is obtained.

On the other hand, although it is shown in the drawings that the second fixing flap 622 extends from the upper part of the membrane side portion 120, the second fixing flap 622 may extends from the first fixing flap 121 at a position spaced inwardly from the membrane side portion 120.

Although the ring-shaped fixture 120*i* and 120*e* having a higher rigidity are coupled only to the inner circumferential surface of the membrane side portion 120, the present invention is not limited thereto. According to another embodiment, the ring-shaped fixtures 120*i* and 120*e* may be coupled only to the outer circumferential surface of the membrane side portion 120 or both to the inner circumferential surface and the outer circumferential surface of the membrane side portion 120 respectively.

On the other hand, although not shown in the drawing, according to another embodiment of the present invention, the membrane is entirely formed of a flexible material so that the bottom portion 110, the membrane side portion 120 and the partition flaps 130 may be freely deformed or expanded and bent. However, the membrane side portion 120 is formed to have a higher rigidity such as by including a different material or by forming a thicker thickness than the first fixing flap 121 or the second fixing flap 122.

Although the figure shows a configuration in which the first inclined parti A1 is extended directly from the upper part of the membrane side portion 120, the present invention is not limited to this. According to another embodiment of the present invention, an additional connecting part may be provided with between the membrane side portion 120 and the first inclined portion A1. Here, it is preferable that the connecting part has a sufficiently high bending stiffness to the extent of the first connection part 122*c*.

Although the figures show configurations in which the first inclined part A1 and the second inclined part A2 have one continuous inclination, the present invention is not limited to this, and according to another embodiment of the present invention, at least one of the inclined part A1 and the second inclined part A2 may be inclined only in a predetermined certain section and any one or more of the first inclined part A1 and the second inclined part A2 may be inclined differently from each other.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

EXPLANATION OF NUMERALS

11: polishing pad
101, 102, 103, 104, 105: membrane
110: membrane bottom portion
120: membrane side portion
120*i*, 120*e*: ring-shaped fixture
121: a first fixing flap
122, 222, 322, 422, 522, 622: a second fixing flap
130, 131, 132, 133, 134: partition flap
201, 202, 203, 204: carrier head
2*x*: main body
22: base
22*a*: engaging member
23: retainer ring
a: angle with the horizontal plane of the first inclined part
A1: a first inclined part
A2: a second inclined part
A3: a third extending part
C1, C2, C3, C4, C5: main pressure chamber
C5: outmost main pressure chamber
Cx: Auxiliary pressure chamber
F1: first force
F2: second force
Fr, Fr': compensation force
Sa: outer surface of base
Sb: bottom surface of base
W: substrate
y: bottom separation distance

What is claimed is:

1. A membrane of a carrier head for a polishing apparatus, comprising:

a bottom portion formed of flexible material to press a substrate during a polishing process;

a side portion formed of at least one material including flexible material and extending from an edge of the membrane bottom portion;

a first fixing flap extending from an upper part of the side portion with an end to be fixed to the carrier head; and a second fixing flap formed of flexible material, including a first inclined part formed to be inclined upwardly and radially inwardly and a second inclined part formed to be inclined upwardly and radially outwardly from a top of the first inclined part, wherein the second fixing flap extends from one of the side portion and the first fixing flap, wherein the first and second fixing flaps form at least part of a bounder of an auxiliary pressure chamber, wherein a first connection part connecting one of the side portion or the second fixing flap to the first fixing flap has a higher rigidity compared with any one of the first inclined part or the second inclined part.

2. The membrane of claim 1, wherein the first connection part is formed thicker than the average thickness of any one of the first inclined part and the second inclined part.

3. A carrier head for a polishing apparatus, comprising:

a main body configured to rotate;

a base, connected to the main body, configured to rotate with the main body during the polishing process;

the membrane of claim 1 fixed to the base wherein the substrate is located beneath the membrane during the polishing process; and a retainer ring formed as a shape of a ring apart from the bottom portion of the membrane to be connected to at least one of the main body or the base for rotating together and configured to be in contact with a polishing pad during the polishing process.

4. A membrane of a carrier head for a polishing apparatus, comprising:

a bottom portion formed of flexible material to press a substrate during a polishing process;

a side portion formed of at least one material including flexible material and extending from an edge of the membrane bottom portion;

a first fixing flap extending from an upper part of the side portion with an end to be fixed to the carrier head; and a second fixing flap formed of flexible material, including a first inclined part formed to be inclined upwardly and radially inwardly and a second inclined part formed to be inclined upwardly and radially outwardly from a top of the first inclined part, wherein the second fixing flap extends from one of the side portion and the first fixing flap, wherein the first and second fixing flaps form at least part of a boundary of an auxiliary pressure chamber, wherein a rotational displacement of the second inclined part is greater than a rotational displacement of the first inclined part when the side portion moves upwards or downwards.

5. The membrane of claim 4, wherein the second inclined part is thinner than the first inclined part.

6. The membrane of claim 4, wherein the first inclined part and the second inclined part has lower rigidity compared with the side portion.

7. A carrier head for a polishing apparatus, comprising:

a main body configured to rotate;

a base, connected to the main body, configured to rotate with the main body during the polishing process;

the membrane of claim 4 fixed to the base wherein the substrate is located beneath the membrane during the polishing process;

and a retainer ring formed as a shape of a ring apart from the bottom portion of the membrane to be connected to at least one of the main body or the base for rotating together and configured to be in contact with a polishing pad during the polishing process.

* * * * *